US006958689B2

(12) United States Patent
Anderson et al.

(10) Patent No.: US 6,958,689 B2
(45) Date of Patent: Oct. 25, 2005

(54) MULTI-SENSOR FIRE DETECTOR WITH REDUCED FALSE ALARM PERFORMANCE

(75) Inventors: Kaare J. Anderson, Farmington, MN (US); Mark S. Miller, Apple Valley, MN (US); Christopher H. Renken, Prior Lake, MN (US); Brian L. Snyder, Jordan, MN (US); David M. Socha, Sr., Champlin, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 69 days.

(21) Appl. No.: 10/606,506

(22) Filed: Jun. 26, 2003

(65) Prior Publication Data

US 2004/0056765 A1 Mar. 25, 2004

Related U.S. Application Data

(63) Continuation-in-part of application No. 10/186,446, filed on Jul. 1, 2002.

(60) Provisional application No. 60/323,824, filed on Sep. 21, 2001.

(51) Int. Cl.[7] ..... G08B 25/00

(52) U.S. Cl. ..... 340/525; 340/628; 340/632; 73/23.31

(58) Field of Search ..... 340/628, 632, 340/522, 525; 73/23.31; G08B 25/00

(56) References Cited

U.S. PATENT DOCUMENTS

| | | | | |
|---|---|---|---|---|
| 4,533,520 A | * | 8/1985 | Bossart et al. | 422/96 |
| 5,153,924 A | | 10/1992 | Van Tyne, Sr. | 382/50 |
| 5,289,275 A | | 2/1994 | Ishii et al. | 348/154 |
| 5,369,397 A | | 11/1994 | Wong | |
| 5,376,924 A | | 12/1994 | Kubo et al. | 340/632 |
| 5,486,811 A | | 1/1996 | Wehrle et al. | 340/522 |
| 5,526,280 A | * | 6/1996 | Consadori et al. | 702/24 |
| 5,528,225 A | * | 6/1996 | Sakai et al. | 340/632 |

(Continued)

FOREIGN PATENT DOCUMENTS

| | | |
|---|---|---|
| DE | 198 50 564 A | 5/2000 |
| EP | 1 103 937 | 5/2001 |
| FR | 2 723 235 A | 2/1996 |
| WO | WO 02/069297 A | 9/2002 |

OTHER PUBLICATIONS

European Search Report for Application No. EP 04013579 Dec. 8, 2004 Rosemount Aerospace.

(Continued)

*Primary Examiner*—Jeffery Hofsass
*Assistant Examiner*—Jennifer Stone
(74) *Attorney, Agent, or Firm*—David R. Perclo; Calfee, Halter & Griswold LLP

(57) ABSTRACT

A method of detecting a combustion chemical in a region and setting an alarm based on concentration levels of the combustion chemical comprises the steps of: monitoring the region for a combustion chemical with a sensor having a measurable parameter which changes in value proportional to concentration levels of the monitored combustion chemical, the measurable parameter being ambient temperature dependent; generating an ambient temperature measurement of the sensor; reading the measurable parameter and ambient temperature measurement; processing the measurable parameter and ambient temperature measurement readings to generate a temperature compensated concentration level of the monitored combustion chemical; and setting an alarm based on the generated temperature compensated concentration level. A fire detector unit for implementing the foregoing described method is also disclosed.

49 Claims, 23 Drawing Sheets

U.S. PATENT DOCUMENTS

| | | | | | |
|---|---|---|---|---|---|
| 6,181,250 | B1 | * | 1/2001 | Brooks, Jr. | 340/577 |
| 6,218,951 | B1 | * | 4/2001 | Colvin | 340/635 |
| 6,622,543 | B1 | * | 9/2003 | Ohmi et al. | 73/23.31 |
| 6,788,197 | B1 | * | 9/2004 | Thuillard et al. | 340/522 |
| 2003/0037590 | A1 | | 2/2003 | Stark | |
| 2003/0058114 | A1 | | 3/2003 | Miller et al. | |

OTHER PUBLICATIONS

Figaro "Signal Processing and Calibration Techniques for CO Detectors Using TGS2442" Brochure. Apr. 2001 pp. 1–10.

* cited by examiner

MULTI-SENSOR FIRE DETECTOR WITH REDUCED FALSE ALARM PERFORMANCE

This application is a continuation-in-part application of U.S. patent application Ser. No. 10/186,446, filed Jul. 1, 2002 which claims the benefit of the provisional patent application No. 60/323,824 filed Sep. 21, 2001.

BACKGROUND OF THE INVENTION

The present invention is directed to fire detectors, in general, and more specifically to a self-contained, multi-sensor, fire detector which utilizes the combination of a smoke detector along with at least two fire byproduct chemical sensors and a temperature sensor, and a controller for monitoring and processing the readings from the detector and sensors to detect the presence of a fire in a storage area with reduced false alarm performance.

It is of paramount importance to detect a fire in an unattended, storage area or enclosed storage compartment at an early stage of progression so that it may be suppressed before spreading to other compartments or areas adjacent or in close proximity to the affected storage area or compartment. This detection and suppression of fires becomes even more critical when the storage compartment is located in a vehicle that is operated in an environment isolated from conventional fire fighting personnel and equipment, like a cargo hold of an aircraft, for example.

Smoke detectors are commonly used to detect a fire in a storage area. However, such detectors operate to detect particulates in the air. Such particulates may arise from smoke, but can also arise from a variety of other sources, such as dust, water vapor (fog) or jet exhaust, for example. Accordingly, the use of a smoke detector by itself to detect a fire in a storage area is susceptible to false alarms. Each false alarm may trigger a fire suppression system to dispense its fire suppressant material into the monitored compartment to put out the perceived fire condition which is costly from the standpoint of replacement and clean-up.

For cargo holds of aircraft, a fire in the hold indication requires not only a dispensing of the fire suppressant material, but also a prompt landing of the aircraft at the nearest airport. The aircraft will then remain out of service until clean up is completed and the aircraft is certified to fly again. This unscheduled servicing of the aircraft is very costly to the airlines and inconveniences the passengers thereof. The costs and inconveniences incurred as a result of the dispensing of the fire suppressant material under false alarm conditions could have been avoided with a more accurate and reliable fire detection system.

The present invention intends to overcome the drawbacks of the current fire detectors and to offer a self-contained, multi-sensor detector which detects a fire accurately and reliably, thus reducing substantially the number of false fire indications.

SUMMARY OF THE INVENTION

In accordance with one aspect of the present invention, a fire detector unit for detecting fire in a region comprises: a chemical sensor for monitoring the region for a combustion chemical and including a first measurable parameter which changes in value proportional to concentration levels of the monitored combustion chemical, the first measurable parameter being ambient temperature dependent; a temperature sensor disposed in proximity to the chemical sensor and including a second measurable parameter which changes in value proportional to the ambient temperature of the chemical sensor; and a processor circuit coupled to the chemical sensor and temperature sensor for reading the first and second measurable parameters thereof, the processor circuit operative to process the first and second parameter readings to generate a temperature compensated concentration level of the monitored combustion chemical, and to generate an alarm based on the generated temperature compensated concentration level.

In accordance with another aspect of the present invention, a method of detecting a combustion chemical in a region and setting an alarm based on concentration levels of the combustion chemical comprises the steps of: monitoring the region for a combustion chemical with a sensor having a measurable parameter which changes in value proportional to concentration levels of the monitored combustion chemical, the measurable parameter being ambient temperature dependent; generating an ambient temperature measurement of the sensor; reading the measurable parameter and ambient temperature measurement; processing the measurable parameter and ambient temperature measurement readings to generate a temperature compensated concentration level of the monitored combustion chemical; and setting an alarm based on the generated temperature compensated concentration level.

In accordance with yet another aspect of the present invention, a method of calibrating a fire detector unit comprising a sensor for monitoring a region for a combustion chemical comprises the steps of: measuring a parameter of the sensor at a plurality of predetermined chemical concentration levels and at a plurality of predetermined first temperatures, the sensor parameter changing in value proportional to concentration levels of the monitored combustion chemical and ambient temperature; creating measured parameter vs. temperature curve data for each of the plurality of predetermined chemical concentration levels based on the parameter measurements; deriving temperature factors at a plurality of second temperatures based on the created measured parameter vs. temperature curve data; and creating temperature factor vs. temperature curve data based on the derived temperature factors.

In accordance with yet another aspect of the present invention, a self-contained, fire detector unit for detecting fire in a region comprises: a smoke detector for monitoring the region for smoke and generating a smoke alarm signal upon the detection of smoke in the region; a plurality of chemical sensors, each sensor of the plurality for monitoring the region for a different combustion chemical and including a first measurable parameter which changes in value proportional to concentration levels of the monitored combustion chemical, the first measurable parameter being ambient temperature dependent; a temperature sensor disposed in proximity to the plurality of chemical sensors and including a second measurable parameter which changes in value proportional to the ambient temperature of the chemical sensors; and a processor circuit coupled to the plurality of chemical sensors, smoke detector and temperature sensor for reading the smoke alarm signal and the first and second measurable parameters thereof, the processor circuit operative to process the first parameter readings of each chemical sensor to generate a corresponding temperature compensated concentration level of the monitored combustion chemical based on the second parameter readings, and to generate an alarm based on a combination of the smoke alarm reading and generated temperature compensated concentration levels of the chemical sensors of the plurality.

In accordance with yet another aspect of the present invention, a self-contained, dual channel fire detector unit for detecting fire in a region comprises first and second channels. The first channel comprises: a first smoke detector for monitoring the region for smoke and generating a first smoke alarm signal upon the detection of smoke in the region; a first plurality of combustion chemical sensors, each sensor of the first plurality for monitoring the region for a different combustion chemical and including a first measurable parameter which changes in value proportional to concentration levels of the monitored combustion chemical, the first measurable parameter being ambient temperature dependent; a first temperature sensor disposed in proximity to the first plurality of combustion chemical sensors and including a second measurable parameter which changes in value proportional to the ambient temperature of the combustion chemical sensors; and a first processor circuit coupled to the first plurality of combustion chemical sensors, first smoke detector and first temperature sensor for reading the first smoke alarm signal and the first and second measurable parameters thereof, the first processor circuit operative to process the first parameter readings of each chemical sensor of the first plurality to generate a corresponding temperature compensated concentration level of the monitored combustion chemical based on the second parameter readings, and to generate a first alarm based on a combination of the first smoke alarm reading and generated temperature compensated concentration levels of the chemical sensors of the first plurality.

The second channel comprises: a second smoke detector for monitoring the region for smoke and generating a second smoke alarm signal upon the detection of smoke in the region; a second plurality of combustion chemical sensors, each sensor of the second plurality for monitoring the region for a different combustion chemical and including a first measurable parameter which changes in value proportional to concentration levels of the monitored combustion chemical, the first measurable parameter being ambient temperature dependent; a second temperature sensor disposed in proximity to the second plurality of combustion chemical sensors and including a second measurable parameter which changes in value proportional to the ambient temperature of the combustion chemical sensors; and a second processor circuit coupled to the second plurality of combustion chemical sensors, second smoke detector and second temperature sensor for reading the second smoke alarm signal and the first and second measurable parameters thereof, the second processor circuit operative to process the first parameter readings of each chemical sensor of the second plurality to generate a corresponding temperature compensated concentration level of the monitored combustion chemical based on the second parameter readings, and to generate a second alarm based on a combination of the second smoke alarm reading and generated temperature compensated concentration levels of the chemical sensors of the second plurality.

DETAILED DESCRIPTION OF THE INVENTION

Figure 1:
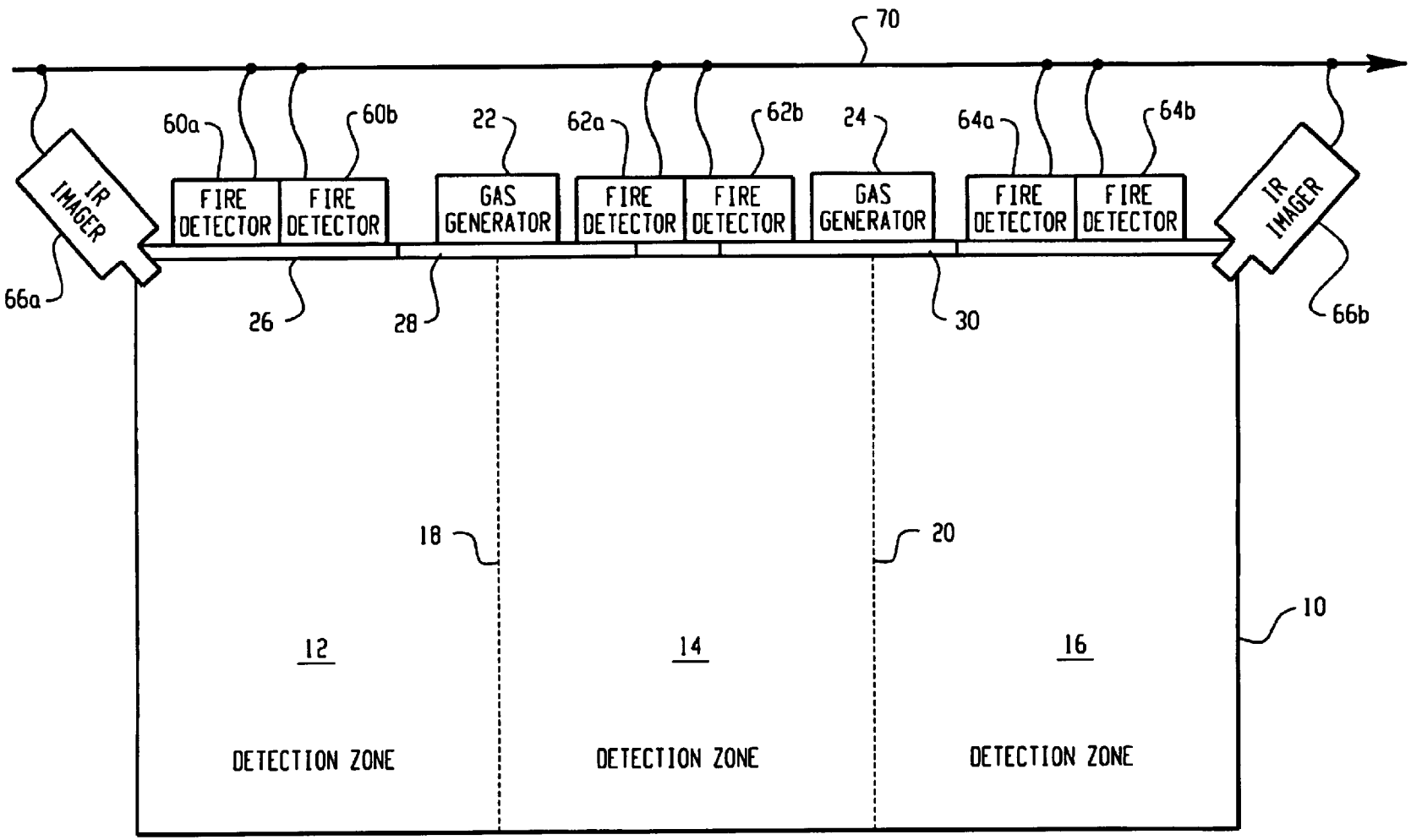
FIG. 1 is a sketch of a fire detection and suppression system for use in a storage compartment suitable for embodying the principles of the present invention.

A sketch of a fire detection and suppression system for use at a storage area or compartment suitable for embodying the principles of the present invention is shown in cross-sectional view in FIG. 1. Referring to FIG. 1, a storage compartment 10 which may be a cargo hold, bay or compartment of an aircraft, for example, is divided into a plurality of detection zones or cavities 12, 14 and 16 as delineated by dashed lines 18 and 20. It is understood that an aircraft may have more than one cargo compartment and the embodiment depicted in FIG. 1 is merely exemplary of each such compartment. It is intended that each of the cargo compartments 10 include one or more gas generators for generating a fire suppressant material. In the present embodiment, a plurality of hermetically sealed, gas generators depicted by blocks 22 and 24, which may be solid propellant in ultra-low pressure gas generators, for example, are disposed at a ceiling portion 26 of the cargo compartment 10 above vented openings 28 and 30 as will be described in greater detail herein below.

In the present embodiment, the propellant of the plurality of gas generators 22 and 24 produces upon ignition an aerosol that is principally potassium bromide. The gaseous products are principally water, carbon dioxide and nitrogen. For aircraft applications, the gas generators 22 and 24 have large multiple orifices instead of the conventional sonic nozzles. As a result, the internal pressure during the discharge period is approximately 10 psig. During storage and normal flight the pressure inside the generator is the normal change in pressure that occurs in any hermetically sealed container that is subjected to changes in ambient conditions.

Test results of gas generators of the solid propellant type are shown in Table 1 below. The concept that is used for ETOPS operations up to 240 minutes is to expend three gas generators of 3½ lbs each for each 2000 cubic feet. This would create the functional equivalent of an 8% Halon 1301 system. At 30 minutes, the concentration would be reduced to the functional equivalent of 4½% Halon 1301. At that point, another gas generator may be expended every 30 minutes. Different quantities of gas generators may be used based upon the size of the cargo bay. It is understood that the size and number of the generators for a cargo compartment may be modified based on the size of the compartment and the specific application

TABLE 1

Requirements Of Present Embodiment vs. Halon in 2000 Cubic Feet

| | Suppression Threshold | Design Minimum | 30 Minute initial Release |
|---|---|---|---|
| Fuel Fire | 3.5 pounds | 4.6 pounds | 9.2 pounds |
| Bulk Load Test | <2.5 pounds | <2.5 pounds | <2.5 pounds |
| Container Test | 3.5 pounds | 4.6 pounds | 9.2 pounds |
| Aerosol Can Test | | 4.6 pounds | |
| Halon requirement | 25 pounds = 3% of Halon | 33 pounds = 4% of Halon | 66 pounds = 8% of Halon |

Figure 10:
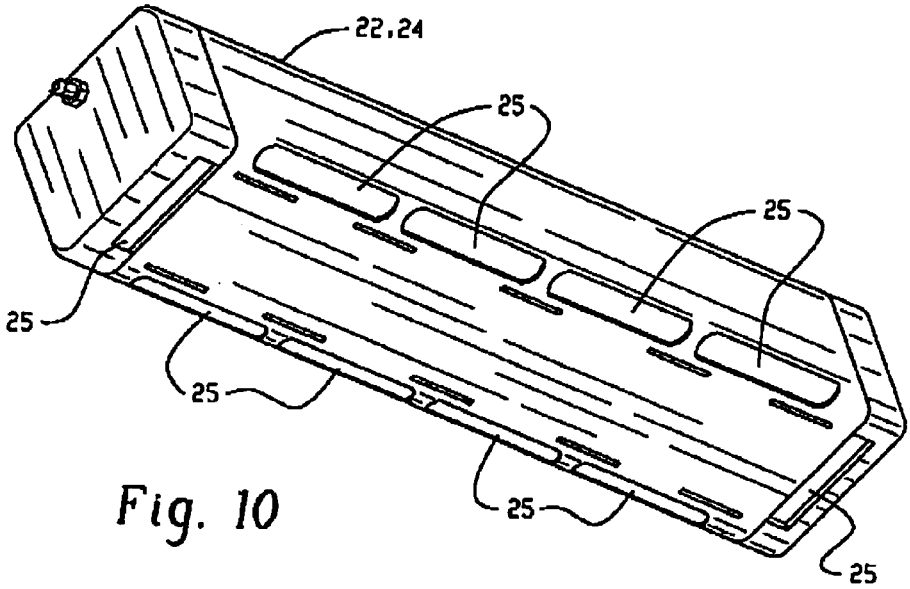
FIG. 10 is an isometric view of an exemplary gas generator illustrating exhaust ports thereof suitable for use in the embodiment of FIG. 1.

An exemplary hermetically sealed, gas generator 22,24 with multiple outlets 25 for use in the present embodiment is shown in the isometric sketch of FIG. 10. The gas generator 22,24 may employ the same or similar initiator that has been used in the U.S. Air Force's ejection seats for many years which has a history of both reliability and safety. Its ignition element consists of two independent 1-watt/1-ohm bridge wires or squibs, for example. The gas generator 22, 24 for use in the present embodiment will be described in greater detail herein below in connection with the break away assembly illustration of FIG. 11.

Figure 2:
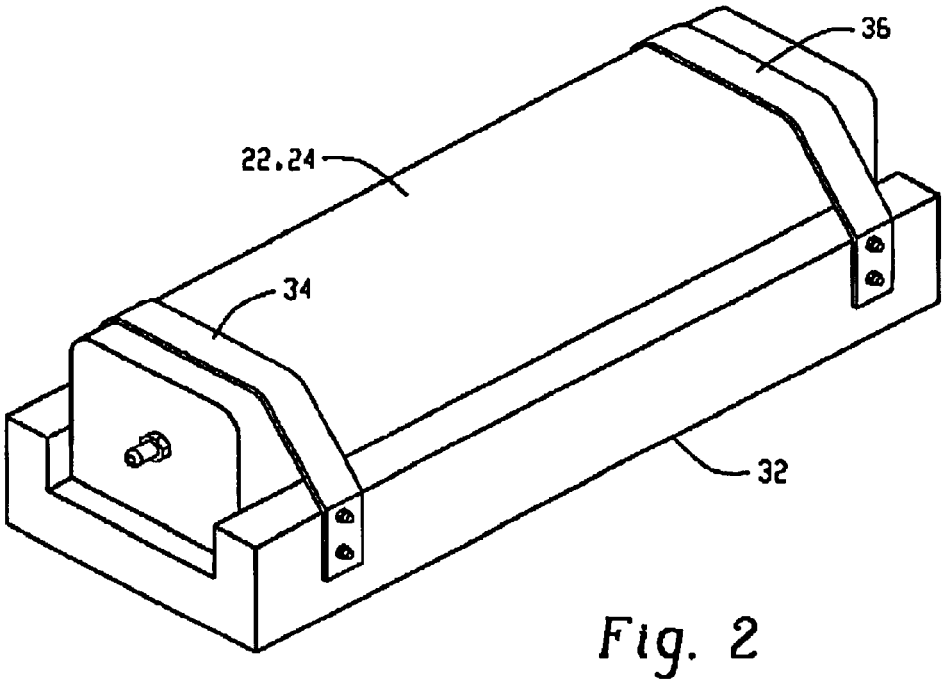
FIGS. 2 and 3 are top and bottom isometric views of an exemplary gas generator assembly suitable for use in the embodiment of FIG. 1.
Figure 3:
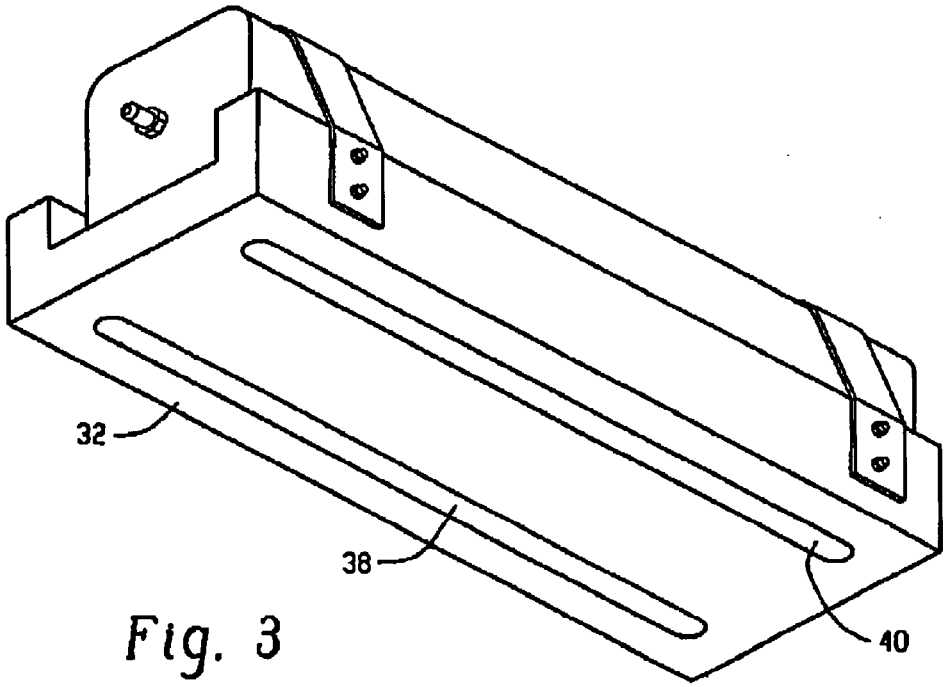

In the top view of FIG. 2 and bottom view of FIG. 3, the sealed container 22,24 is shown mounted to a base 32 by supporting straps 34 and 36, for example. The bottom of the base 32 which has a plurality of openings 38 and 40 may be mounted to the ceiling 26 over vented portions 28 and 30 thereof to permit passage of the aerosol and gaseous fire suppressant products released or exhausted from the gas generator via outlets 25 out through the vents 28 and 30 and into the compartment 10.

Figure 4:
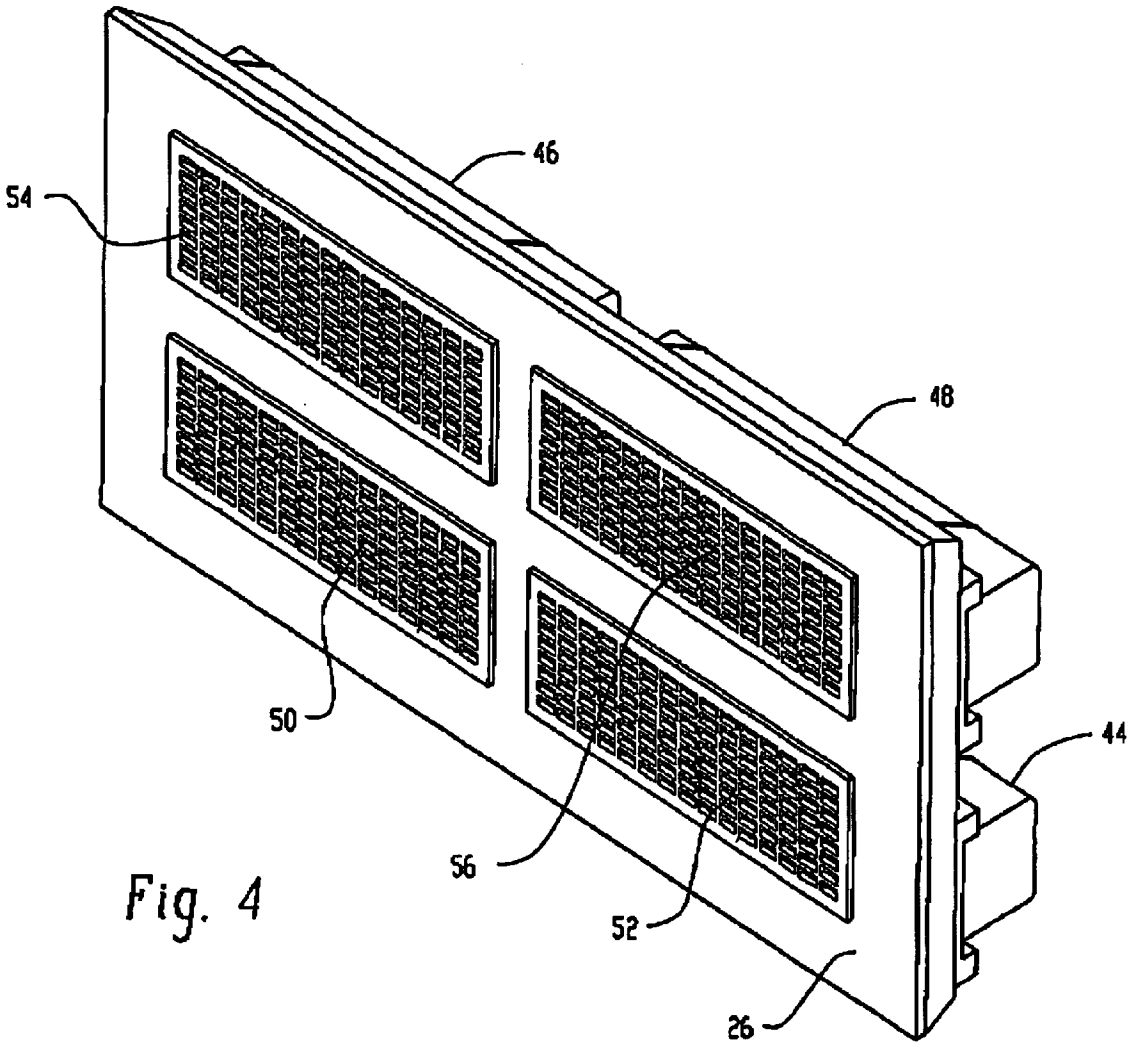
FIGS. 4 and 5 are bottom and top isometric views of an exemplary gas generator assembly compartment mounting suitable for use in the embodiment of FIG. 1.
Figure 5:
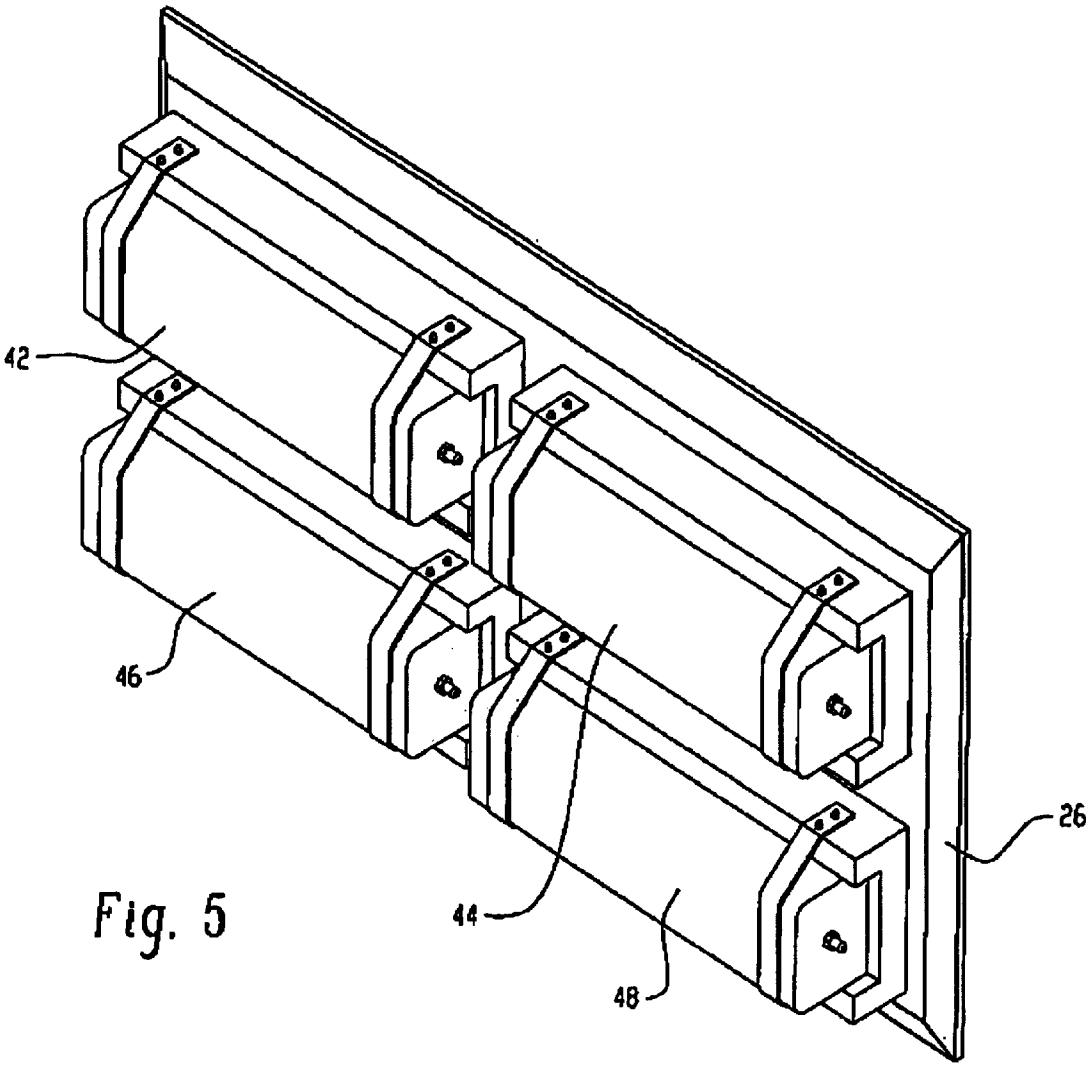

The present example employs four gas generators for compartment 10 which are shown in bottom view in FIG. 4 and top view in FIG. 5. As shown in FIGS. 4 and 5, in the present embodiment, each of the four gas generators 42, 44, 46 and 48 is installed with its base over a respectively corresponding vented portion 50, 52, 54, 56 of the ceiling 26. Accordingly, when initiated, each of the gas generators will generate and release its aerosol and gaseous fire suppressant products through the openings in its respective base and vented portion of the ceiling into the compartment 10.

With the present embodiment, the attainment of 240 or 540 minutes or longer of fire suppressant discharge is a function of how many gas generators are used for a compartment. It is expected that the suppression level will be reached in an empty compartment in less than 10 seconds, for example. This time may be reduced in a filled compartment. Aerosol tests demonstrated that the fire suppressant generated by the gas generators is effective for fuel/air explosives also. In addition, the use of independent gas generator systems for each cargo compartment further improved the system's effectiveness. For a more detailed description of solid propellant gas generators of the type contemplated for the present embodiment, reference is made to the U.S. Pat. bearing U.S. Pat. No. 5,861,106, issued Jan. 19, 1999, and entitled "Compositions and Methods For Suppressing Flame" which is incorporated by reference herein. This patent is assigned to Universal Propulsion Company, Inc. which is the same assignee and/or a wholly-owned subsidiary of the parent company of the assignee of the instant application. A divisional application of the referenced '106 patent was later issued as U.S. Pat. No. 6,019,177 on Feb. 1, 2000 having the same ownership as its parent '106 patent.

Referring back to FIG. 1, as explained above, each cargo compartment 10 may be broken into a plurality of detection zones 12, 14 and 16. The number of zones in each cargo compartment will be determined after sufficient testing and analysis in order to comply with the application requirements, like a one minute response time, for example. The present embodiment includes multiple fire detectors distributed throughout each cargo compartment 10 with each fire detector including a variety of fire detection sensors. For example, there may be two fire detectors installed in each zone 12, 14 and 16 in a dual-loop system. The two fire detectors in each zone may be mounted next to each other, inside pans located above the cargo compartment ceiling 26, like fire detectors 60*a* and 60*b* for zone 12, fire detectors 62*a* and 62*b* for zone 14 and 64*a* and 64*b* for zone 16, for example. In the present embodiment, each of the fire detectors 60*a*, 60*b*, 62*a*, 62*b*, 64*a* and 64*b* may contain three different fire detection sensors: a smoke detector, a carbon monoxide (CO) gas detector, and hydrogen ($H_2$) gas detector as will be described in greater detail herein below. While in the present application a specific combination of fire detection sensors is being used in a fire detector, it is understood that in other applications or storage areas, different combinations of sensors may be used just as well.

In addition, at least one IR imager may be disposed at each cargo compartment 10 for fire detection confirmation, but it is understood that in some applications imagers may not be needed. In the present embodiment, two IR imagers 66*a* and 66*b* may be mounted in opposite top corners of the compartment 10, preferably behind a protective shield, in the dual-loop system. This mounting location will keep each imager out of the actual compartment and free from damage. Each imager 66*a* and 66*b* may include a wide-angle lens so that when aimed towards the center or bottom center of the compartment 10, for example, the angle of acceptance of the combination of two imagers will permit a clear view of the entire cargo compartment including across the ceiling and down the side walls adjacent the imager mounting. It is intended for the combination of imagers to detect any hot cargo along the top of the compartment, heat rise from cargo located below the top, and heat reflections from the compartment walls. Each fire detector 60*a*, 60*b*, 62*a*, 62*b*, 64*a* and 64*b* and IR imagers 66*a* and 66*b* will include self-contained electronics for determining independently whether or not it considers a fire to be present and generates a signal indicative thereof as will be described in greater detail herein below.

Figure 8A:
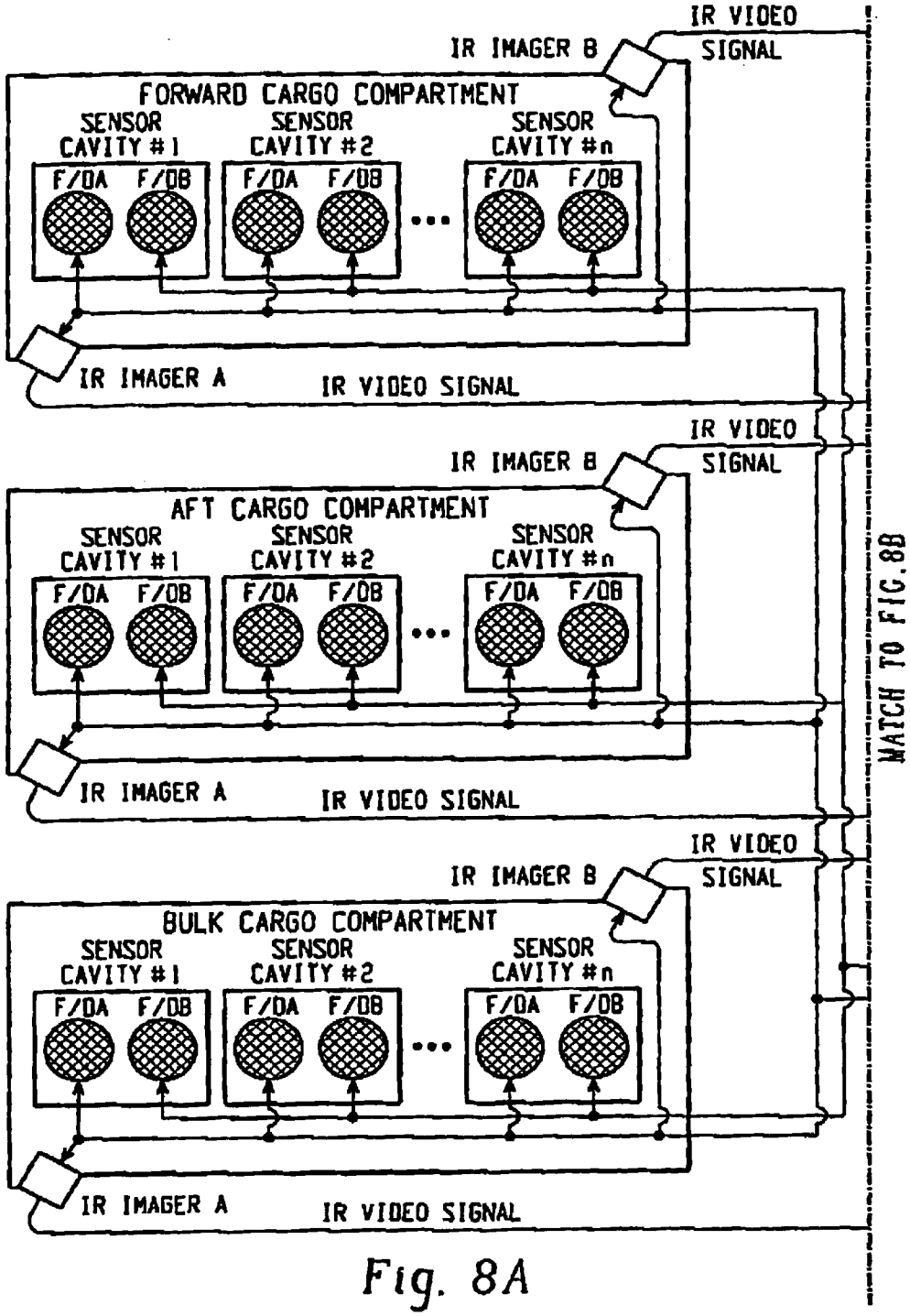
FIG. 8 is a block diagram schematic of an overall fire detection system suitable for use in the application of an aircraft.
Figure 8B:
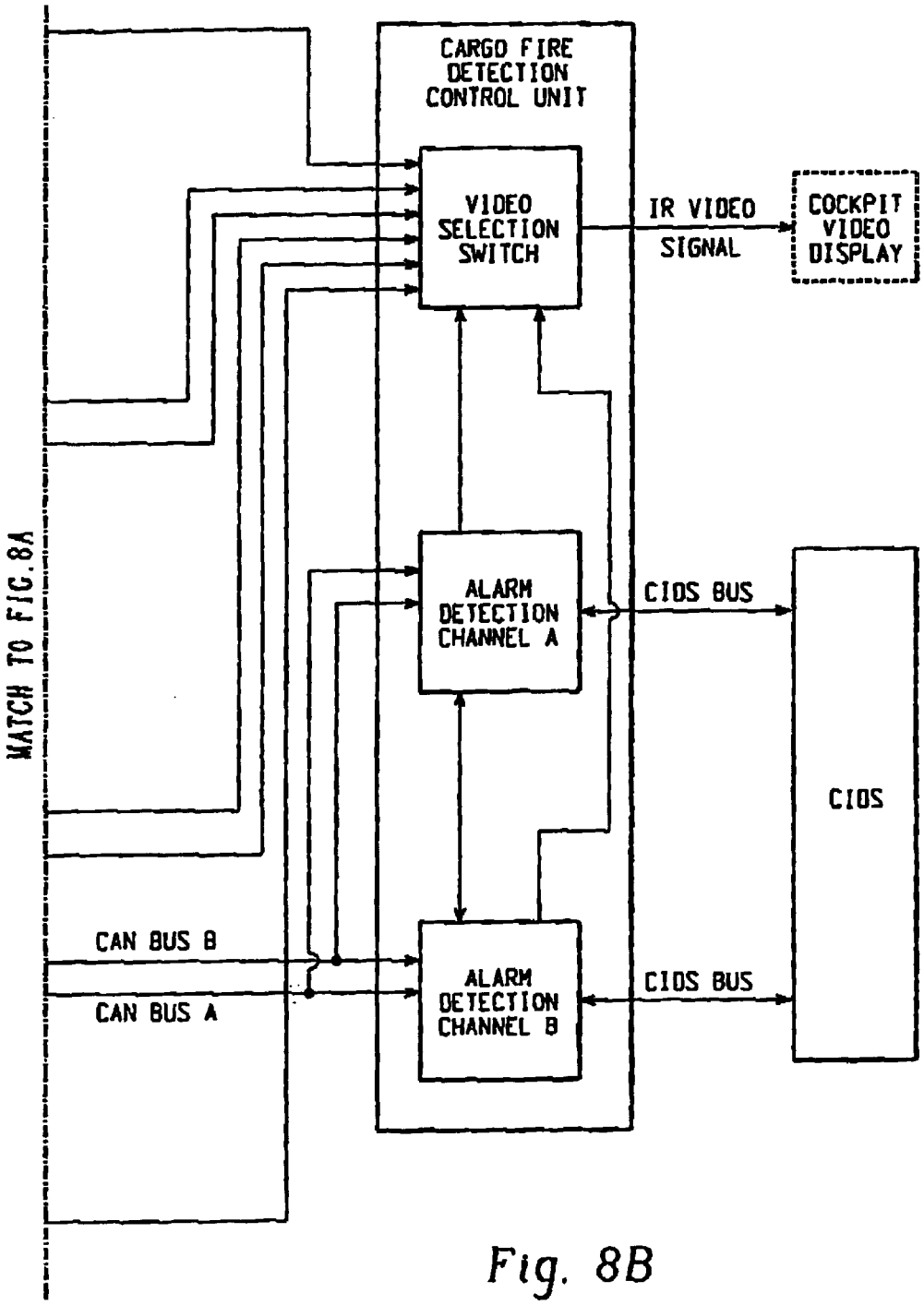

All fire detectors and IR imagers of each cargo compartment 10 may be connected in a dual-loop system via a controller area network (CAN) bus 70 to cargo fire detection control unit (CFDCU) as will be described in more detail in connection with the block diagram schematic of FIG. 8. The location of the CFDCU may be based on the particular application or aircraft, for example. A suitable location for mounting the CFDCU in an aircraft is at the main avionics bay equipment rack.

Figure 6:
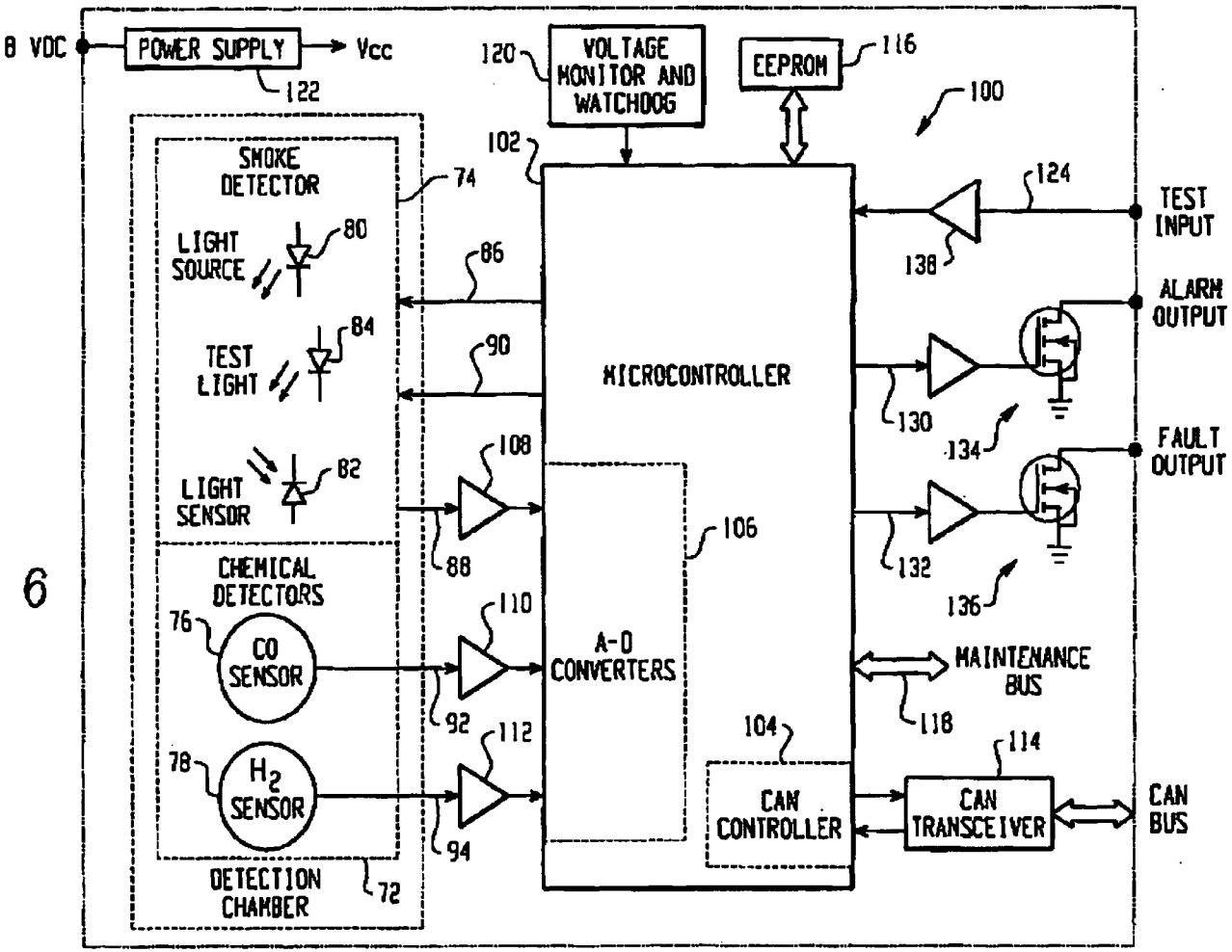
FIG. 6 is a block diagram schematic of an exemplary fire detector unit suitable for use in the embodiment of FIG. 1.

A block diagram schematic of an exemplary fire detector unit suitable for use in the present embodiment is shown in FIG. 6. Referring to FIG. 6, all of the sensors used for fire detection are disposed in a detection chamber 72 which includes a smoke detector 74, a carbon monoxide (CO) sensor 76, and a hydrogen ($H_2$) sensor 78, for example. The smoke detector 74 may be a photoelectric device that has been and is currently being used extensively in such applications as aircraft cargo bays, and lavatory, cabin, and electronic bays, for example. The smoke detector 74 incorporates several design features which greatly improves system operational reliability and performance, like free convection design which maximizes natural flow of the smoke through the detection chamber, computer designed detector labyrinth which minimizes effects of external and reflected light, chamber screen which prevents large particles from entering the detector labyrinth, use of solid state optical components which minimizes size, weight, and power consumption while increasing reliability and operational life, provides accurate and stable performance over years of operation, and offers an immunity to shock and vibration, and isolated electronics which completes environmental isolation of the detection electronics from the contaminated smoke detection chamber.

More specifically, in the smoke detector, a light emitting diode (LED) 80 and photoelectric sensor (photo diode) 82 are mounted in an optical block within the labyrinth such that the sensor 82 receives very little light normally. The labyrinth surfaces may be computer designed such that very little light from the LED 80 is reflected onto the sensor, even when the surfaces are coated with particles and contamination build-up. The LED 80 may be driven by an oscillating signal 86 that is synchronized with a photodiode detection signal 88 generated by the photodiode 82 in order to maximize both LED emission levels and detection and/or noise rejection. The smoke detector 74 may also include built-in test electronics (BITE), like another LED 84 which is used as a test light source. The test LED 84 may be driven by a test signal 90 that may be also synchronized with the photodiode detection signal 88 generated by the photodiode 82 in order to better effect a test of the proper operation of the smoke detector 74.

Chemical sensors 76 and 78 may be each integrated on and/or in a respective semiconductor chip of the microelectromechanical system (MEMS)-based variety for monitoring and detecting gases which are the by-products of combustion, like CO and $H_2$, for example. The semiconductor chips of the chemical sensors 76 and 78 may be each mounted in a respective container, like a TO-8 can, for example, which are disposed within the smoke detection chamber 72. The TO-8 cans include a screened top surface to allow gases in the environment to enter the can and come in contact with the semiconductor chip which measures the CO or $H_2$ content in the environment.

More specifically, in the present embodiment, the semiconductor chip of the CO sensor 76 uses a multilayer MEMS structure. A glass layer for thermal isolation is printed between a ruthenium oxide ($RuO_2$) heater and an alumina substrate. A pair of gold electrodes for the heater is formed on a thermal insulator. A tin oxide ($SnO_2$) gas sensing layer is printed on an electrical insulation layer which covers the heater. A pair of gold electrodes for measuring sensor resistance or conductivity is formed on the electrical insulator for connecting to the leads of the TO-8 can. Activated charcoal is included in the area between the internal and external covers of the TO-8 can to reduce the effect of noise gases. In the presence of CO, the conductivity of sensor 76 increases depending on the gas concentration in the environment. The CO sensor 76 generates a signal 92 which is representative of the CO content in the environment detected thereby. It may also include BITE for the testing of proper operation thereof. This type of CO sensor displayed good selectivity to carbon monoxide.

In addition, the semiconductor chip of the $H_2$ sensor 78 in the present embodiment comprises a tin dioxide ($SnO_2$) semiconductor that has low conductivity in clean air. In the presence of $H_2$, the sensor's conductivity increases depending on the gas concentration in the air. The $H_2$ sensor 78 generates a signal 94 which is representative of the $H_2$ content in the environment detected thereby. It may also include BITE for the testing of proper operation thereof. Integral heaters and temperature sensors within both the CO and $H_2$ sensors, 76 and 78, respectively, stabilize their performance over the operating temperature and humidity ranges and permit self-testing thereof. For a more detailed description of such MEMS-based chemical sensors reference is made to the co-pending patent application bearing No. 09/940,408, filed on Aug. 27, 2001 and entitled "A Method of Self-Testing A Semiconductor Chemical Gas Sensor Including An Embedded Temperature Sensor" which is incorporated by reference herein. This application is assigned to Rosemount Aerospace Inc. which is the same assignee and/or a wholly-owned subsidiary of the parent company of the assignee of the instant application.

Each fire detector also includes fire detector electronics 100 which may comprise solid-state components to increase reliability, and reduce power consumption, size and weight. The heart of the electronics section 100 for the present embodiment is a single-chip, highly-integrated conventional 8-bit microcontroller 102, for example, and includes a CAN bus controller 104, a programmable read only memory (ROM), a random access memory (RAM), multiple timers (all not shown), multi-channel analog-to-digital converter (ADC) 106, and serial and parallel I/O ports (also not shown).The three sensor signals (smoke 88, CO 92, and $H_2$ 94) may be amplified by amplifiers 108, 110 and 112, respectively, and fed into inputs of the microcontroller's ADC 106. Programmed software routines of the microcontroller 102 will control the selection/sampling, digitization and storage of the amplified signals 88, 92 and 94 and may compensate each signal for temperature effects and compare each signal to a predetermined alarm detection threshold. In the present embodiment, an alarm condition is determined to be present by the programmed software routine if all three sensor signals are above their respective detection threshold. A signal representative of this alarm condition is transmitted along with a digitally coded fire detection source identification tag to the CFDCU over the CAN bus 70 using the CAN controller 104 and a CAN transceiver 114.

Using preprogrammed software routines, the microcontroller 102 may perform the following primary control functions for the fire detector: monitoring the smoke detector photo diode signal 88, which varies with smoke concentration; monitoring the CO and $H_2$ sensor conductivity signals 92 and 94, which varies with their respective gas concentration; identifying a fire alarm condition, based on the monitored sensor signals; receiving and transmitting signals over the CAN bus 70 via controller 104 and transceiver 114; generating discrete ALARM and FAULT output signals 130 and 132 via gate circuits 134 and 36, respectively; monitoring the discrete TEST input signal 124 via gate 138; performing built-in-test functions as will be described in greater detail herebelow; and generating supply voltages from a VDC power input via power supply circuit 122.

In addition, the microcontroller 102 communicates with a non-volatile memory 116 which may be a serial EEPROM (electrically erasable programmable read only memory), for example, that stores predetermined data like sensor calibration data and maintenance data, and data received from the CAN bus, for example. The microcontroller 102 also may have a serial output data bus 118 that is used for maintenance purposes. This bus 118 is accessible when the detector is under maintenance and is not intended to be used during normal field operation. It may be used to monitor system performance and read detector failure history for troubleshooting purposes, for example. All inputs and outputs to the fire detector are filtered and transient protected to make the detector immune to noise, radio frequency (RF) fields, electrostatic discharge (ESD), power supply transients, and lightning. In addition, the filtering minimizes RF energy emissions.

Each fire detector may have BITE capabilities to improve field maintainability. The built-in-test will perform a complete checkout of the detector operation to insure that it detects failures to a minimum confidence level, like 95%, for example. In the present embodiment, each fire detector may perform three types of BITE: power-up, continuous, and initiated. Power-up BITE will be performed once at power-up and will typically comprise the following tests: memory test, watchdog circuit verification, microcontroller operation test (including analog-to-digital converter operation), LED and photo diode operation of the smoke detector 74, smoke detector threshold verification, proper operation of the chemical sensors 76 and 78, and interface verification of the CAN bus 70. Continuous BITE testing may be performed on a continuous basis and will typically comprise the following tests: LED operation, Watchdog and Power supply (122) voltage monitor using the electronics of block 120, and sensor input range reasonableness. Initiated BITE testing may be initiated and performed when directed by a discrete TEST Detector input signal 124 or by a CAN bus command received by the CAN transceiver 114 and CAN controller 104 and will typically perform the same tests as Power-up BITE.

Figure 7:
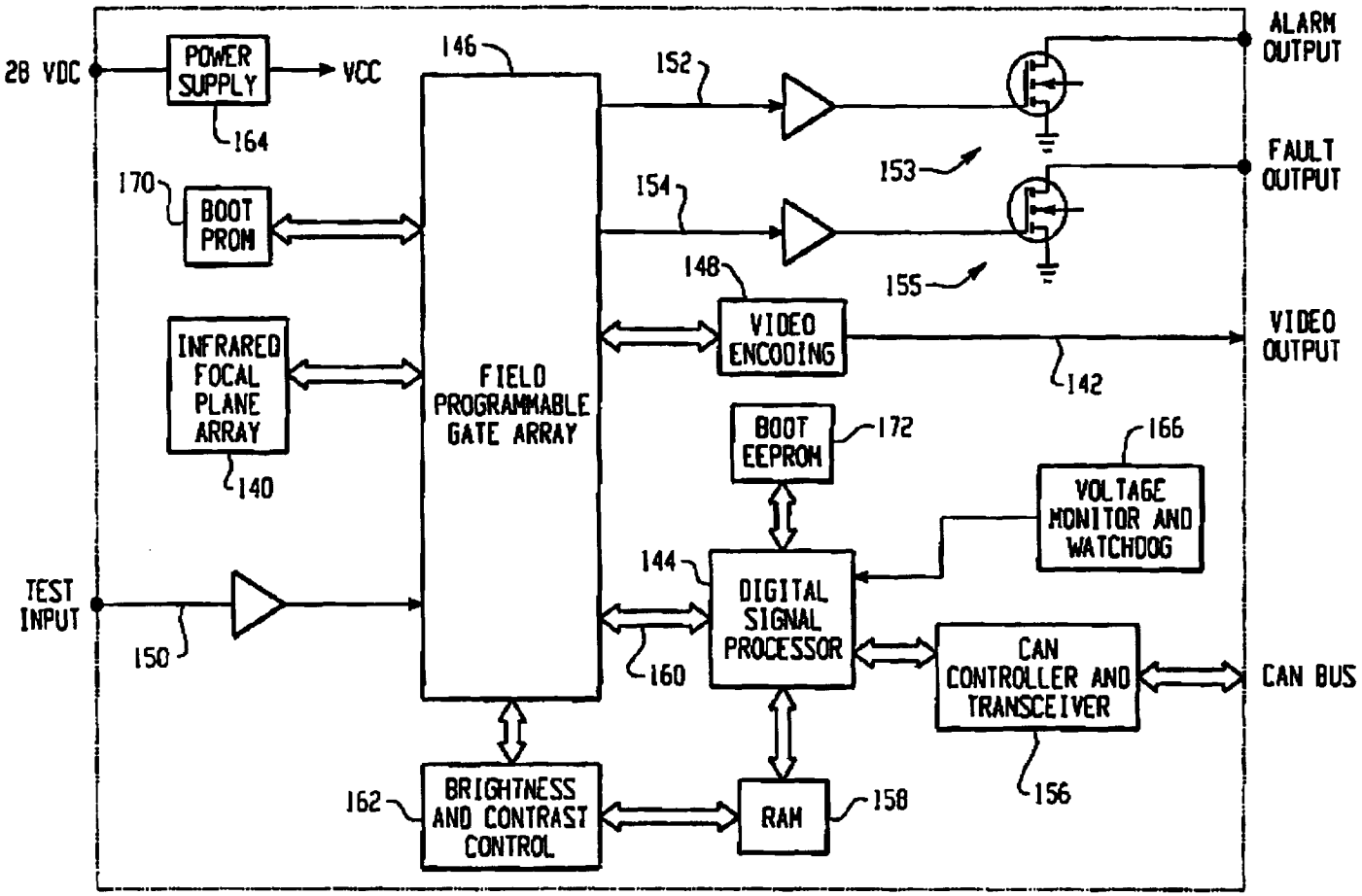
FIG. 7 is a block diagram schematic of an exemplary imager unit suitable for use in the embodiment of FIG. 1.

A block diagram schematic of an exemplary IR imager suitable for use in the fire detection system of the present embodiment is shown in FIG. 7. Referring to FIG. 7, each imager is based on infrared focal plane array technology. A focal plane infrared imaging array 140 detects optical wavelengths in the far infrared region, like on the order of 8–12 microns, for example. Thermal imaging is done at around 8–12 microns since room temperature objects emit radiation in these wavelengths. The exact field-of-view of a wide-angle, fixed-focus lens of the IR imager will be optimized based on the imager's mounting location as described in connection with the embodiment of FIG. 1. Each imager 66*a* and 66*b* is connected to and controlled by the CAN bus 70. Each imager may output a video signal 142 to the aircraft cockpit in the standard NTSC format. Similar to the fire detectors, the imagers may operate in both "Remote Mode" and "Autonomous Mode", as commanded by the CAN bus 70.

The imager's infrared focal plane array (FPA) 140 may be an uncooled microbolometer with 320 by 240 pixel resolution, for example, and may have an integral temperature sensor and thermoelectric temperature control. Each imager may include a conventional digital signal processor (DSP) 144 for use in real-time, digital signal image processing. A field programmable gate array (FPGA) 146 may be programmed with logic to control imager components and interfaces to the aircraft, including the FPA 140, a temperature controller, analog-to-digital converters, memory, and video encoder 148. Similar to the fire detectors, the FPGA 146 of the imagers may accept a discrete test input signal 150 and output both an alarm signal 152 and a fault signal 154 via circuits 153 and 155, respectively. The DSP 144 is preprogrammed with software routines and algorithms to perform the video image processing and to interface with the CAN bus via a CAN bus controller and transceiver 156.

The FPGA 146 may be programmed to command the FPA 140 to read an image frame and digitize and store in a RAM 158 the IR information or temperature of each FPA image picture element or pixel. The FPGA 146 may also be programmed to notify the DSP 144 via signal lines 160 when a complete image frame is captured. The DSP 144 is preprogrammed to read the pixel information of each new image frame from the RAM 158. The DSP 144 is also programmed with fire detection algorithms to process the pixel information of each frame to look for indications of flame growth, hotspots, and flicker. These algorithms include predetermined criteria through which to measure such indications over time to detect a fire condition. When a fire condition is detected, the imager will output over the CAN bus an alarm signal along with a digitally coded source tag and the discrete alarm output 152. The algorithms for image signal processing may compensate for environmental concerns such as vibration (camera movement), temperature variation, altitude, and fogging, for example. Also, brightness and contrast of the images generated by the FPA 140 may be controller by a controller 162 prior to the image being stored in the RAM 158.

In addition, the imager may have BITE capabilities similar to the fire detectors to improve field maintainability. The built-in-tests of the imager may perform a complete checkout of its operations to insure that it detects failures to a minimum confidence level, like around 95%, for example. Each imager 66*a* and 66*b* may perform three types of BITE: power-up, continuous, and initiated. Power-up BITE may be performed once at power-up and will typically consist of the following: memory test, watchdog circuit and power supply (164) voltage monitor verification via block 166, DSP operation test, analog-to-digital converter operation test, FPA operation test, and CAN bus interface verification, for example. Continuous BITE may be performed on a continuous basis and will typically consist of the following tests: watchdog, power supply voltage monitor, and input signal range reasonableness. Initiated BITE may be performed when directed by the discrete TEST Detector input signal 150 or by a CAN bus command and will typically perform the same tests as Power-up BITE. Also, upon power up, the FPGA 146 may be programmed from a boot PROM 170 and the DSP may be programmed from a boot EEPROM 172, for example.

A block diagram schematic of an exemplary overall fire detection system for use in the present embodiment is shown in FIG. 8. In the example of FIG. 8, the application includes three cargo compartments, namely: a forward or FWD cargo compartment, and AFT cargo compartment, and a BULK cargo compartment. As described above, each of these compartments are divided into a plurality of n sensor zones or cavities #1, #2, . . . , #n and in each cavity there are disposed a pair of fire detectors F/D A and F/D B. Each of the compartments also include two IR imagers A and B disposed in opposite comers of the ceilings thereof to view the overall space of the compartment in each case. Alarm condition signals generated by the fire detectors and IR imagers of the various compartments are transmitted to the CFDCU over a dual loop bus, CAN bus A and CAN bus B. In addition, IR video signals from the IR imagers are conducted over individual signal lines to a video selection switch of the CFDCU which selects one of the IR video signals for display on a cockpit video display.

In the present embodiment, the CFDCU may contain two identical, isolated alarm detection channels A and B. Each channel A and B includes software programs to process and independently analyze the inputs from the fire Detectors and IR imagers of each cargo compartment FWD, AFT and BULK received from both buses CAN bus A and CAN bus B and determine a true fire condition/alarm and compartment source location thereof. A "true" fire condition may be detected by all types of detectors of a compartment, therefore, a fire alarm condition will only be generated if both: (1) the smoke and/or chemical sensors detect the presence of a fire, and (2) the IR imager confirms the condition or vice versa. If only one sensor detects fire, the alarm will not be activated. This AND-type logic will minimize false alarms. This alarm condition information may be sent to a cabin intercommunication data system (CIDC) over data buses, CIDS bus A and CIDS bus B and to other locations based on the particular application. Besides the CAN bus interface, each fire detector and IR imager will have discrete Alarm and Fault outputs, and a discrete Test input as described herein above in connection with the embodiments of FIGS. 6 and 7. As required, each component may operate in either a "Remote Mode" or "Autonomous Mode".

As shown in the block diagram schematic embodiment of FIG. 8, the Cargo Fire Detection Control Unit (CFDCU) interfaces with all cargo fire detection and suppression apparatus on an aircraft, including the fire detectors and IR imagers of each compartment, the Cockpit Video Display, and the CIDS. It will be shown later in connection with the embodiment of FIG. 9 that the CFDCU also interfaces with the fire suppression gas generator canisters, and a Cockpit Fire Suppression Switch Panel. Accordingly, the CFDCU provides all system logic and test/fault isolation capabilities. It processes the fire detector and IR Imager signals input thereto to determine a fire condition and provides fire indication to the cockpit based on embedded logic. Test functions provide an indication of the operational status of each individual fire detector and IR imager to the cockpit and aircraft maintenance systems.

More specifically, the CFDCU incorporates two identical channels that are physically and electrically isolated from each other. In the present embodiment, each channel A and B is powered by separate power supplies. Each channel contains the necessary circuitry for processing Alarm and Fault signals from each fire detector and IR imager of the storage compartments of the aircraft. Partitioning is such that all fire detectors and IR imagers in both loops A and B of the system interface to both channels via dual CAN busses to achieve the dual loop functionality and full redundancy for optimum dispatch reliability. The CFDCU acts as the bus controller for the two CAN busses that interface with the fire detectors and IR imagers. Upon determining a fire indication in the same zone of a compartment by both loops A and B, the CFDCU sends signals to the CIDS over the data buses, for eventual transmission to the cockpit that a fire condition is detected. The CFDCU may also control the video selector switch to send an IR video image of the affected cargo compartment to the cockpit video display to allow the compartment to be viewed by the flight crew.

Figure 9:
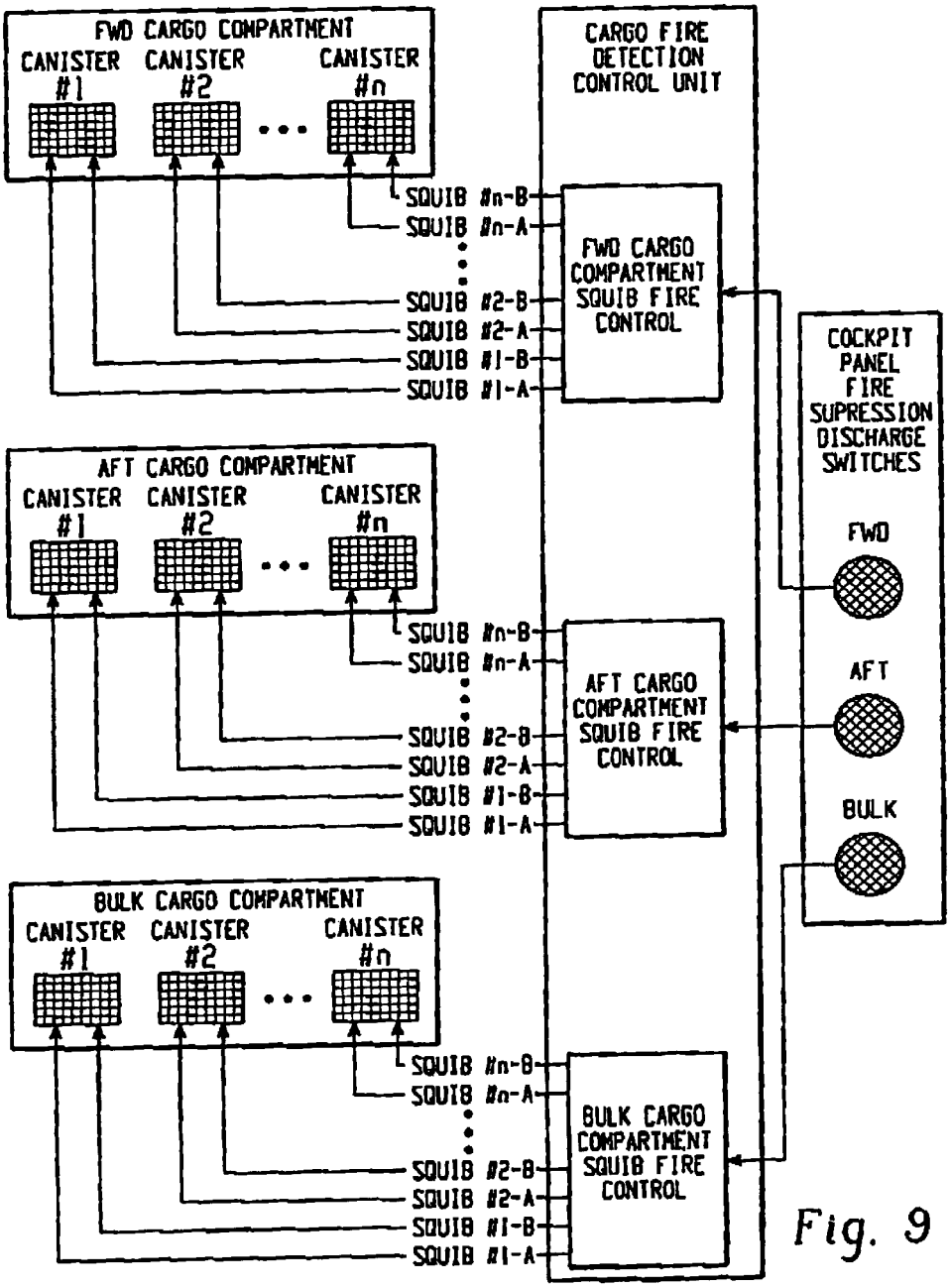
FIG. 9 is a block diagram schematic of an exemplary fire suppression system suitable for use in the application of an aircraft.

A block diagram schematic of an exemplary overall fire suppression system suitable for use in the present embodiment is shown in FIG. 9. As shown in FIG. 9, Squib fire controllers in the CFDCU also monitor and control the operation of the fire suppression canisters, #1, #2, . . . #n in the various compartments of the aircraft through use of squib activation signals Squib #1-A, Squib #1-B, . . . , Squib #n-A and Squib #n-B, respectively. Upon receipt of a discrete input from a fire suppression discharge switch on the Cockpit Fire Suppression Switch Panel, the respective squib fire controller fires the squibs in the suppressant canisters, as required. Verification that the squibs have fired is sent to the cockpit via the CIDS as shown in FIG. 8. The CFDCU may include BITE capabilities to improve field maintainability. These capabilities may include the performance of a complete checkout of the operation of CFDCU to insure that it detects failures to a minimum confidence level of on the order of 95%, for example.

More specifically, the CFDCU may perform three types of BITE: power-up, continuous, and initiated. Power-up BITE will be performed once at power-up and will typically consist of the following tests: memory test, watchdog circuit verification, microcontroller operation test, fire detector operation, IR imager operation, fire suppressant canister operation, and CAN bus interface verification, for example. Continuous BITE may be performed on a continuous basis and will typically consist of the following tests: watchdog and power supply voltage monitor, and input signal range reasonableness. Initiated BITE may be performed when directed by a discrete TEST Detector input or by a bus command and will typically perform the same tests as Power-up BITE.

The exemplary gas generators 22, 24 of the present embodiment will now be described in greater detail in connection with the break away assembly illustration of FIG. 11. The assembly is small enough to mount in unusable spaces in the storage compartment, e.g. cargo hold of an aircraft, and provides an ignition source for the propellant and a structure for dispensing hot aerosol while protecting the adjoining mounting structure of the aircraft, for example, from the hot aerosol. A modular assembly of the gas generator supports and protects the fire suppressant propellant during shipping, handling and use by a tubular housing 180. The modular design also allows the assembly to be used on various sized and shaped compartment or cargo holds by choosing the number of assemblies for each size. This assembly may be mountable within the space between the ceiling of the cargo hold and the floor of the cabin compartment as described in connection with the embodiment of FIG. 1. In the assembly, the propellant is supported by sheet metal baffles that force the hot aerosol to flow through the assembly allowing them to cool before being directed into the cargo hold through several exhaust ports 25. These ports 25 are closed with a plastic that hermetically seals the dispenser which provides the dual purpose of protecting the propellant from the environment as well as the environment from the propellant. An integral igniter is included in the assembly, which meets a 1-watt, 1-amp no-fire requirement.

Figure 11:
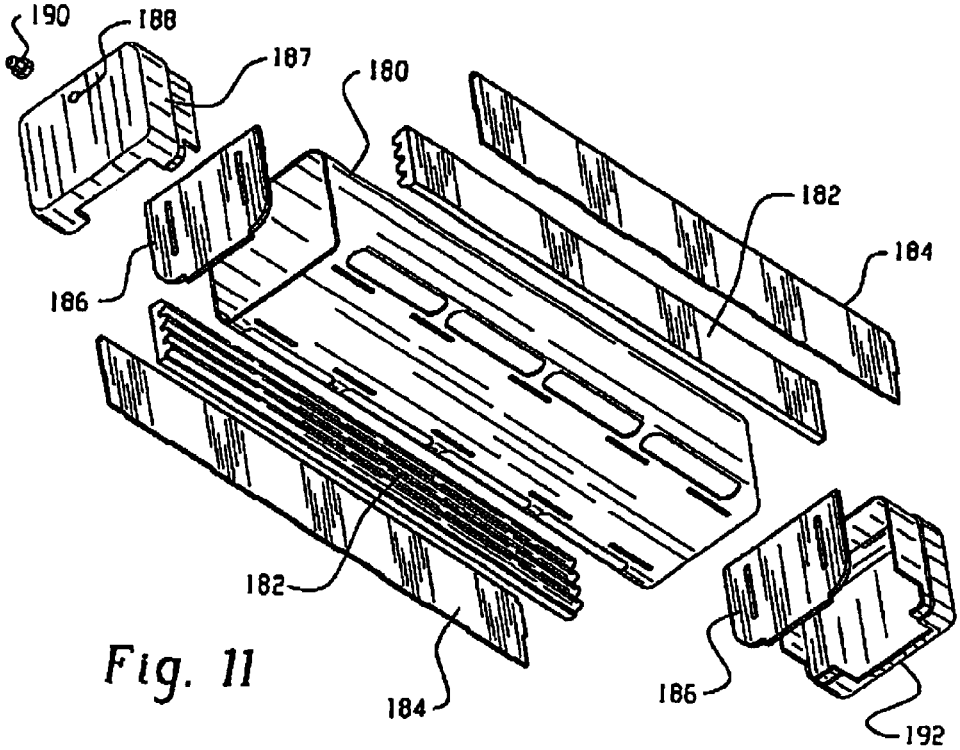
FIG. 11 is a break away assembly illustration of the gas generator of FIG. 10.

Referring to FIG. 11, more specifically, the assembly comprises a substantially square tube or housing 180 which may have dimensions of approximately 19" in length and 4" by 4" square, for example. The tube 180 supports the rest of the assembly. Several holes are stamped in one wall of the tube or housing 180 to provide mounting for mating parts and ports 25 that are used to direct the fire suppressant aerosol into the cargo hold. Two extruded propellants 182 which may be approximately 3⅓ pounds, for example, are mounted flat to surfaces of two sheet metal baffles 184, respectively. The baffles 184 are in turn mounted vertically within the square gas generator such that a gap between the top of the baffles 184 and the inside of the tube 180 exists to allow the hot aerosol to flow over the baffles 184 and out the ports 25 in the tube. Two additional baffles 186 cover the ends of the tubular housing 180. One end of the assembly is closed with a snap-on cap 187 which has a port 188 to secure a through bulkhead electrical connector 190. The other end of the assembly is also closed with another snap-on end cap 192. Inside the assembly attached to a face of each of the propellants 182 is a strip of ignition material that is ignited by an electric match. The electrical leads of the electric matches are connected to the through bulkhead electrical connector in order to provide the ignition current to the electric matches.

Figure 12:
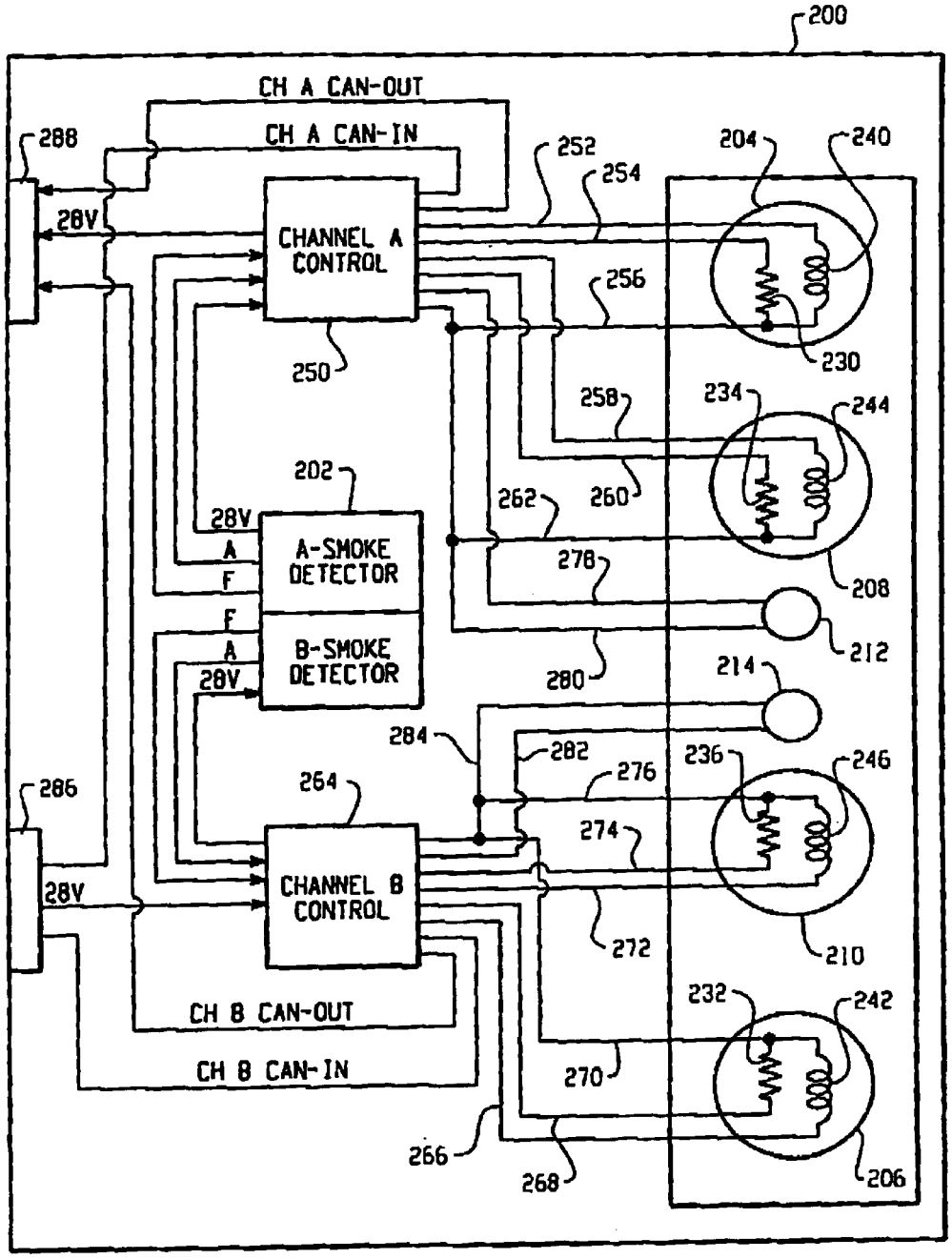
FIG. 12 is a block diagram schematic of a self-contained, multi-sensor fire detector unit suitable for embodying an aspect of the present invention.

Another fire detector suitable for use in the fire detection system is embodied in a self-contained, multi-sensor unit 200 as shown in the block diagram schematic of FIG. 12. Referring to FIG. 12, the unit 200 comprises a dual smoke detector unit 202, dual sensors 204 and 206 for sensing the concentration of one fire byproduct chemical, like the gas hydrogen ($H_2$), for example, and dual sensors 208 and 210 for sensing the concentration of another fire byproduct chemical, like the gas carbon monoxide (CO), for example, a temperature sensor 212 disposed in close proximity to the chemical sensors 204 and 208 for sensing the ambient temperature thereof, and a temperature sensor 214 disposed in close proximity to the chemical sensors 206 and 210 for sensing the ambient temperature thereof.

Figure 13:
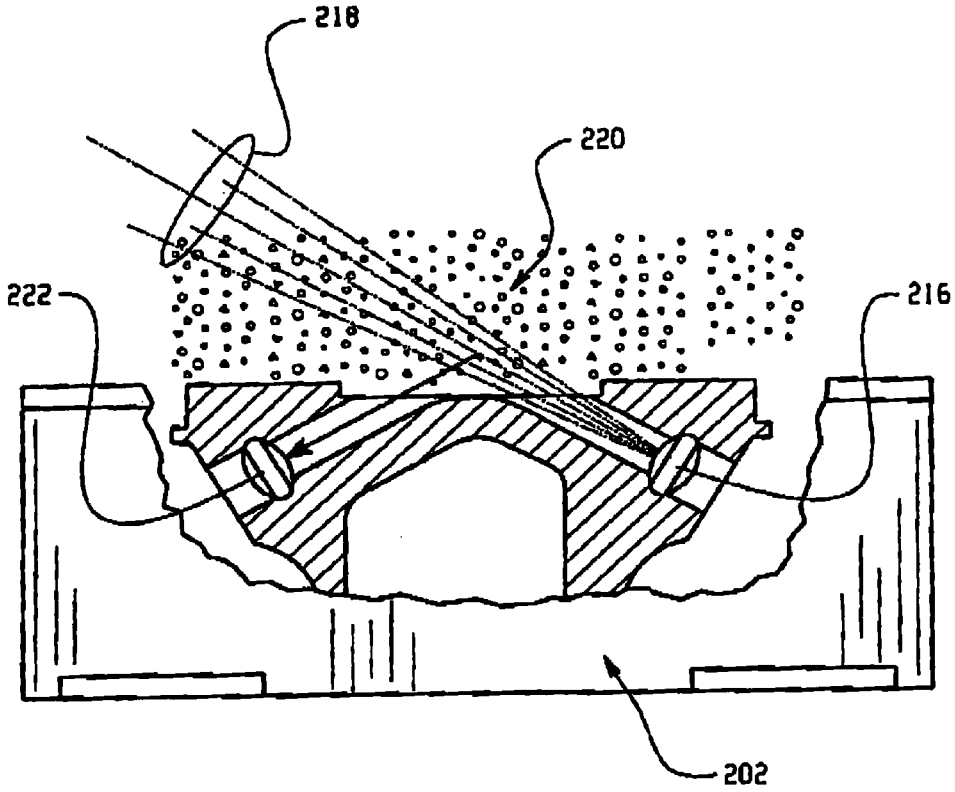
FIG. 13 is a cut away, cross-sectional illustration of a smoke detector suitable for use in the fire detector unit of FIG. 12.

The dual smoke detector unit 202 which may be of the type manufactured by Meggitt Co. under the model no. 602, for example, comprises smoke detectors A and B for separately and independently monitoring the air for smoke particulates. In the present embodiment, each smoke detector A and B is of the photoelectric type, an exemplary embodiment of which being shown in the cut away, cross-sectional illustration of FIG. 13. Referring to FIG. 13, a light emitting diode 216 is disposed within each smoke detector of unit 202 and configured to emit a beam of light 218 substantially at a predetermined bandwidth or range of bandwidths into a region of air above the unit 202. If smoke particulates 220 are present in the region, light will be reflected from the particulates. Some of the reflected light depicted by the darkened arrow is directed to a photodetector 222 also disposed within each smoke detector of unit 202 wherein the received light is converted to an electrical signal. The detector 222 may be biased such to produce a high-active or low-active alarm signal when the concentration of particulates 220 reaches a predetermined level representative of a fire alarm condition.

Each smoke detector A and B of unit 202 may also include a built in test circuit similar to that described in connection with the smoke detector 74 herein above and which is operative to generate a fault signal indicative of a fault condition in the respective smoke detector A and B. In addition, in the present embodiment, each smoke detector A and B of unit 202 is powered by a supply voltage which may be approximately +28 Vdc, for example, in which case the alarm signal (A) and fault signal (F) output from each smoke detector A and B may be at or close to +28 Vdc.

Returning to FIG. 12, each of the $H_2$ gas sensors 204 and 206 may be of the type manufactured by Figaro Co. under the model no. TGS821, for example, and each of the CO gas sensors 208 and 210 may be of the type manufactured by Figaro Co. under the model no. TGS2442, for example. While only $H_2$ and CO sensors are provided in the present embodiment, it is understood that other chemical sensors may be used for sensing additional fire byproducts without deviating from the broad principles of the present invention. More specifically, each of the gas sensors 204, 206, 208 and 210 include a resistive element 230, 232, 234 and 236, respectively, which changes in resistance in proportion to the sensed concentration of the respective gaseous fire byproduct. Each of the gas sensors 204, 206, 208 and 210 also includes a self-contained heater coil 240, 242, 244 and 246, respectively, which is used to heat its corresponding resistive sensing element to a temperature that is desirable for sensing the target gas. The heater coils may be also used to clean their corresponding sensing elements by burning off any debris, moisture, . . . etc. which may affect the reading.

The heater coil 240 and resistive element 230 of the gas sensor 204 are driven by a channel A control PC card 250 over signal lines 252 and 254, respectively, and return lines 256. Likewise, the heater coil 244 and resistive element 234 of sensor 208 are driven by the channel A PC card 250 over signal lines 258 and 260, respectively, and return lines 262. Similarly, the heater coil 242 and resistive element 232 of sensor 206 are driven by a channel B control PC card 264 over signal lines 266 and 268, respectively, and return lines 270. Likewise, the heater coil 246 and resistive element 236 of sensor 210 are driven by the channel B control card 264 over signal lines 272 and 274, respectively, and return lines 276. In addition, each of the temperature sensors 212 and 214 which may be of the solid-state type manufactured by National Semiconductor under model number LM50, for example, is driven by the respective channel A and channel B control cards over signal/return lines 278/280 and 282/284, respectively. It is understood that the aforementioned sensors are specified by way of example and that other type sensors may be used without deviating from the broad principles of the present invention. The interface of these exemplary sensors with their respective A and B control cards 250 and 264 will become more evident from the description found herein below in connection with FIGS. 14,15A and 15B.

Still referring to FIG. 12, the channel A and channel B control cards are supplied power over the voltage supply +28 Vdc, for example. Each channel control card A and B produces alarm and fault messages of their respective combination of sensors over a suitable communication bus, like a CAN bus, for example. For example, the channel A control card 250 produces alarm and fault messages over the CHA CAN bus, and likewise, the channel B control card 254 produces alarm and fault messages over the CHB CAN bus. In the present embodiment, the CHA and CHB CAN buses are input to the unit 200 through pins of a connector 286, passed through their respective channel control cards 250 and 264, and output from the unit 200 through pins of a connector 288 to effect a daisy chaining among all units connected to the dual CAN buses. The dual CAN buses are distributed in the fire detection system in a similar manner to that described herein above in connection with the embodiment of FIGS. 8A and 8B, for example. In addition, the 28 Vdc power is also daisy chained to the unit 200 through connectors 286 and 288. For example, the 28 Vdc supply is passed from connector 286 through the channel B control card, the smoke detectors of the unit 202, and the channel A control card and output from unit 200 through connector 288.

Figure 14:
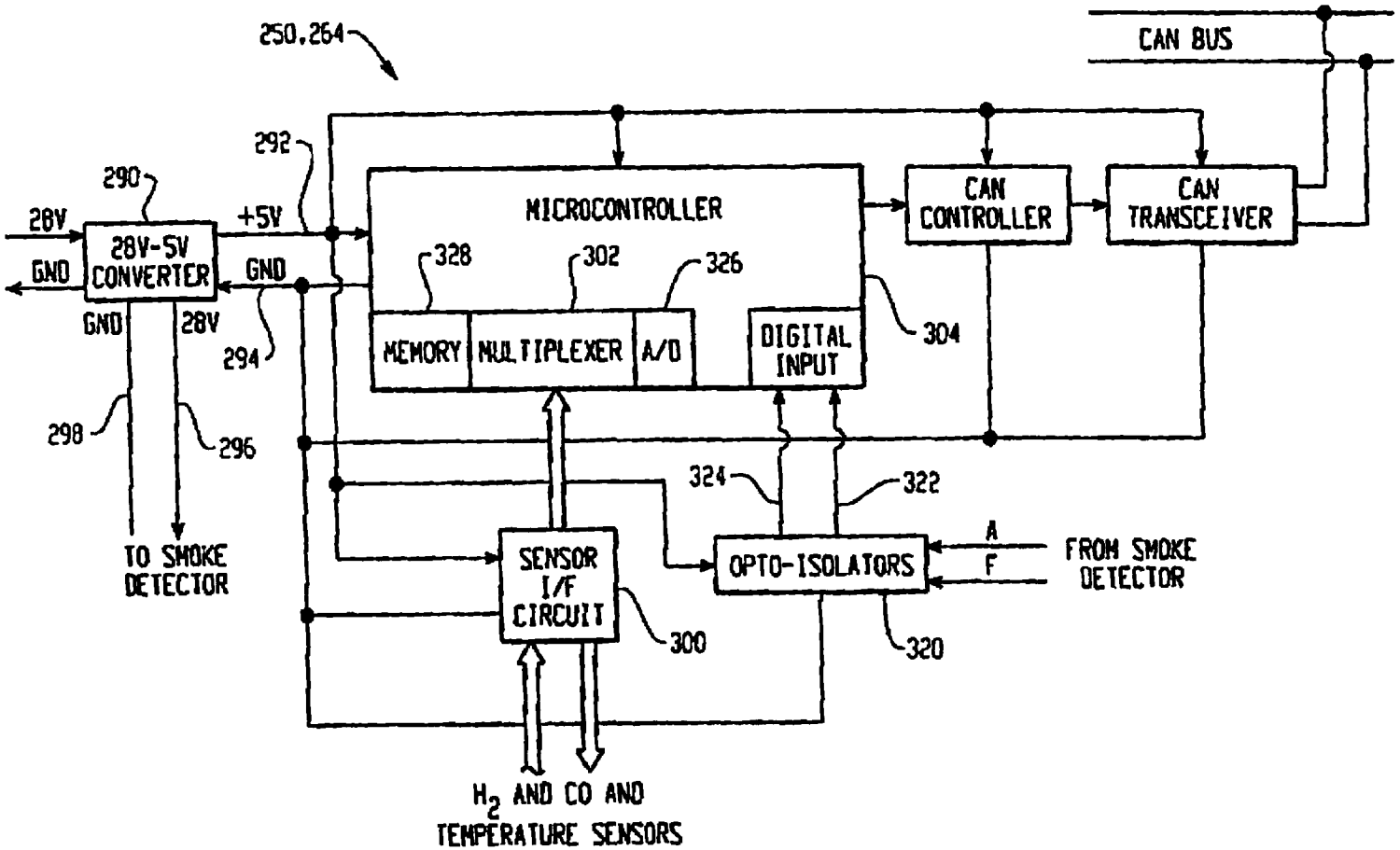
FIG. 14 is a block diagram schematic of an exemplary embodiment of a channel control unit suitable for use in the fire detector unit of FIG. 12.

A suitable embodiment for each of the channel A and channel B control cards 250 and 264, respectively, is shown in the block diagram schematic of FIG. 14. Referring to FIG. 14, the 28 Vdc supply for each card may be converted and regulated to a lower supply voltage level, like +5 Vdc, for example, by a DC—DC voltage converter circuit 290. The +5 Vdc is distributed to the various circuits of the control card over a power bus 292 for the powering thereof. A separate ground return for the +5 Vdc supply is provided over the return bus 294 from the various circuits. In addition, the 28 Vdc is conditioned in the converter circuit 290 and distributed to the respective smoke detector over power bus 296 with a ground return over line 298.

Figure 15A:
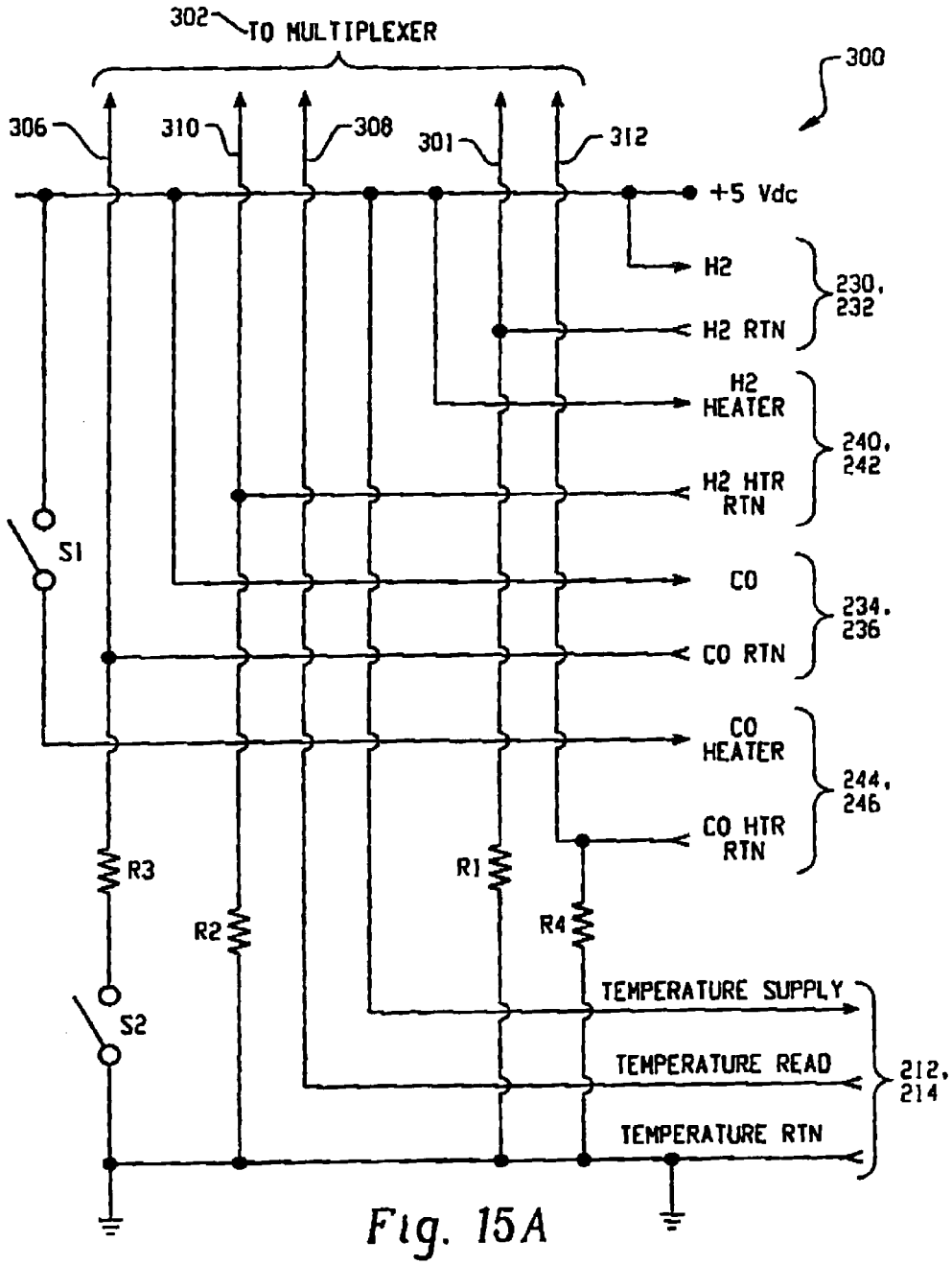
FIG. 15A is a schematic of an exemplary sensor interface circuit suitable for use in the channel control unit of FIG. 14.

Each control card 250, 264 includes a sensor interface (I/F) circuit 300 for driving and receiving measurement signals from the various chemical and temperature sensors. A suitable embodiment of a sensor I/F circuit 300 is shown in the circuit schematic of FIG. 15A. Referring to FIG. 15A, a resistor RI is coupled in series with the resistive element 230,232 of the respective $H_2$ sensor 204,206 between the +5V and ground to form a resistor divider network. The voltage across the resistor RI is provided over line 301 to an input of a multiplexer circuit 302 which may be integrated within a microcontroller 304 on the control card 250,264 (see FIG. 14). The microcontroller 304 may be of the type manufactured by Atmel under the model no. ATMega16L, for example. Likewise, a resistor R3 is coupled in series with the resistive element 234,236 of the respective CO sensor 208, 210 between the +5V supply and ground to form a resistor divider network. The voltage across resistor R3 is provided over signal line 306 to another input of the multiplexer circuit 302.

Further, the temperature sensor 212, 214 is coupled between the +5V supply and ground. The temperature sensor 212, 214 used in the present embodiment produces a voltage signal output which is linearly proportional to the ambient temperature being sensed thereby. Each temperature sensor may sense temperature over a range of −40 to +125° C., for example. The temperature representative voltage signal is provided to another input of the multiplexer circuit 302 over signal line 308. In addition, one end of the heater coil 240, 242 of the respective $H_2$ sensor 204, 206 is coupled to the +5V and the other end of the respective heater coil 240, 242 is coupled to a ground return through a series resistor R2. The voltage across the resistor R2 is provided to another input of the multiplexer circuit 302 over a signal line 310. In a similar manner, one end of the heater coil 244, 246 of the respective CO sensor 208, 210 is coupled to the +5V supply and the other end of the respective heater coil 244, 246 is coupled to a ground return through a series resistor R4. The voltage across the resistor R4 is provided to another input of the multiplexer circuit 302 over a signal line 312.

A switch S1 may be coupled in series with the heater coil of the respective CO sensor and controlled by the microcontroller 304 for pulse modulating the heating current to the coil 244, 246. In the present embodiment, switch S1 may be pulsed for fourteen milliseconds (14 msec.) every second. Another switch S2 is coupled between R3 and ground and controlled by the microcontroller 304 for taking readings of the CO gas sensing element 234, 236. In the present embodiment, switch S2 may be pulsed for five milliseconds (5 msec.) every second.

In operation, the microcontroller 304 under program control may address the multiplexer 302 to read in the voltages across the resistors R1 and R3 of the respective $H_2$, CO sensors and the voltage signal of the temperature sensors at predetermined intervals, like every one second, for example. These voltages are representative of the resistance of the sensor elements and the ambient temperatures. Likewise, the microcontroller 304 via the multiplexer 302 monitors the voltages across the resistors R2 and R4 every so often under program control to determine if the respective sensor is operating properly. For example, if the heating coil of a sensor open circuits or shorts out, the voltages of R2 and R4 will reflect this fault condition.

Figure 15B:
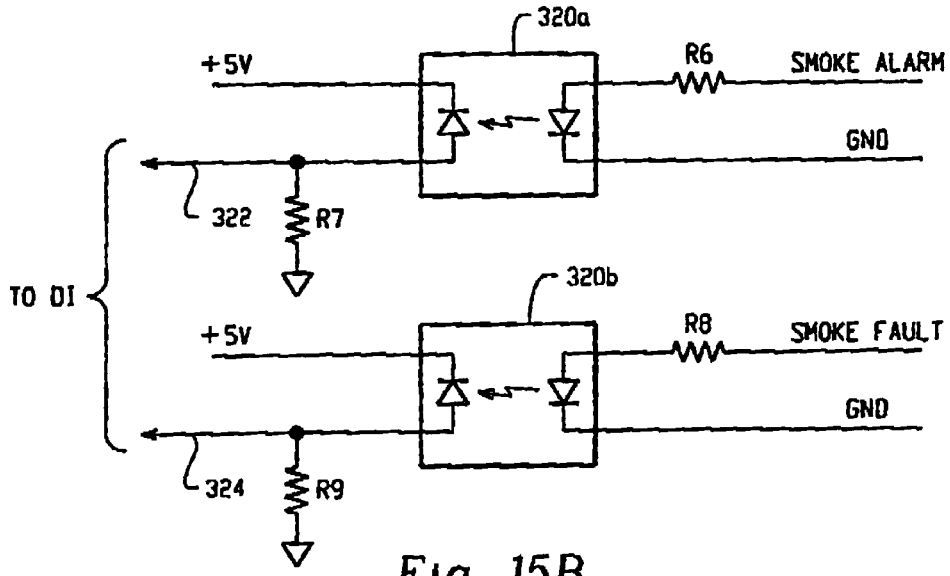
FIG. 15B is a schematic of exemplary opto-isolator circuitry suitable for use in the channel control unit of FIG. 14.

Since, in the present embodiment, the smoke alarm (A) and fault (F) signals are at or near 28 Vdc and the circuits of the control card 250, 264 operate at +5V, a voltage translation is performed by a set of opto-isolators 320 as shown in FIGS. 14 and 15B. Referring to FIGS. 14 and 15B, the respective smoke alarm signal (A) is coupled to a light emitting diode (LED) of one of the opto-isolators 320*a* through a current limiting resistor R6. A light detector of the opto-isolator 320*a*, which may be a photodiode, for example, is coupled between the +5V supply and ground through a series resistor R7 and the voltage across R7 is provided to a digital input (DI) of the microcontroller 304 over signal line 322. Thus, when the A signal is at the alarm status, current will flow through the LED to produce light which is represented by the wavy arrowed line. Light from the LED turns "on" the photodiode permitting current to flow from the +5V supply through resistor R7 causing a voltage across R7 at or near +5V. This voltage translated alarm signal is monitored by the microcontroller 304 via the signal line 322 and designated DI under program control. The voltage translation opto-isolator circuit for the respective smoke fault signal F is similar to that just described for the A signal utilizing opto-isolator 320*b*, current limiting resistor R8 and light detecting series resistor R9. The translated voltage fault signal across R9 is provided to another DI of the microcontroller 304 over signal line 324 for monitoring.

As noted above in connection with the embodiment of FIG. 14, the microcontroller 304 under program control monitors the raw measurement and fault signals of the respective temperature and chemical sensors every one second, for example, via the multiplexer circuit 302. In the present embodiment, each raw measurement and fault signal is digitized by an analog-to-digital converter (A/D) circuit 326 and stored in designated registers of a memory 328. Each of the A/D circuit 326 and memory 328 may be an integral part of the microcontroller 304. The respective smoke detector A and F signals are read in directly through their designated digital inputs. As will be described in greater detail herein below, the microcontroller 304 processes the monitored signals from the respective smoke detector, temperature and chemical sensors to generate fire alarm and fault signal messages over the CAN bus via corresponding CAN controller and CAN transceiver circuits which are well known to all those skilled in the pertinent art.

Figure 16:
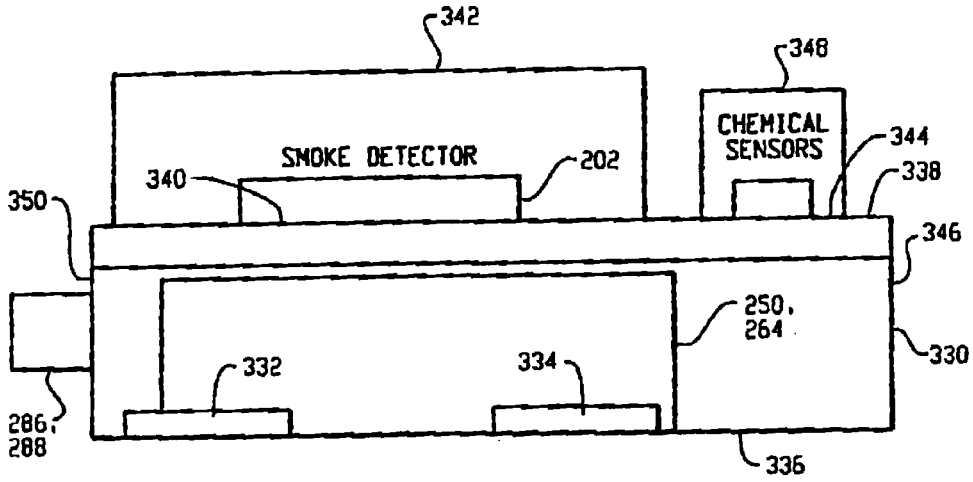
FIG. 16 is a cross-sectional illustration of an exemplary self-contained, multi-sensor fire detector assembly suitable for embodying another aspect of the present invention.
Figure 17:
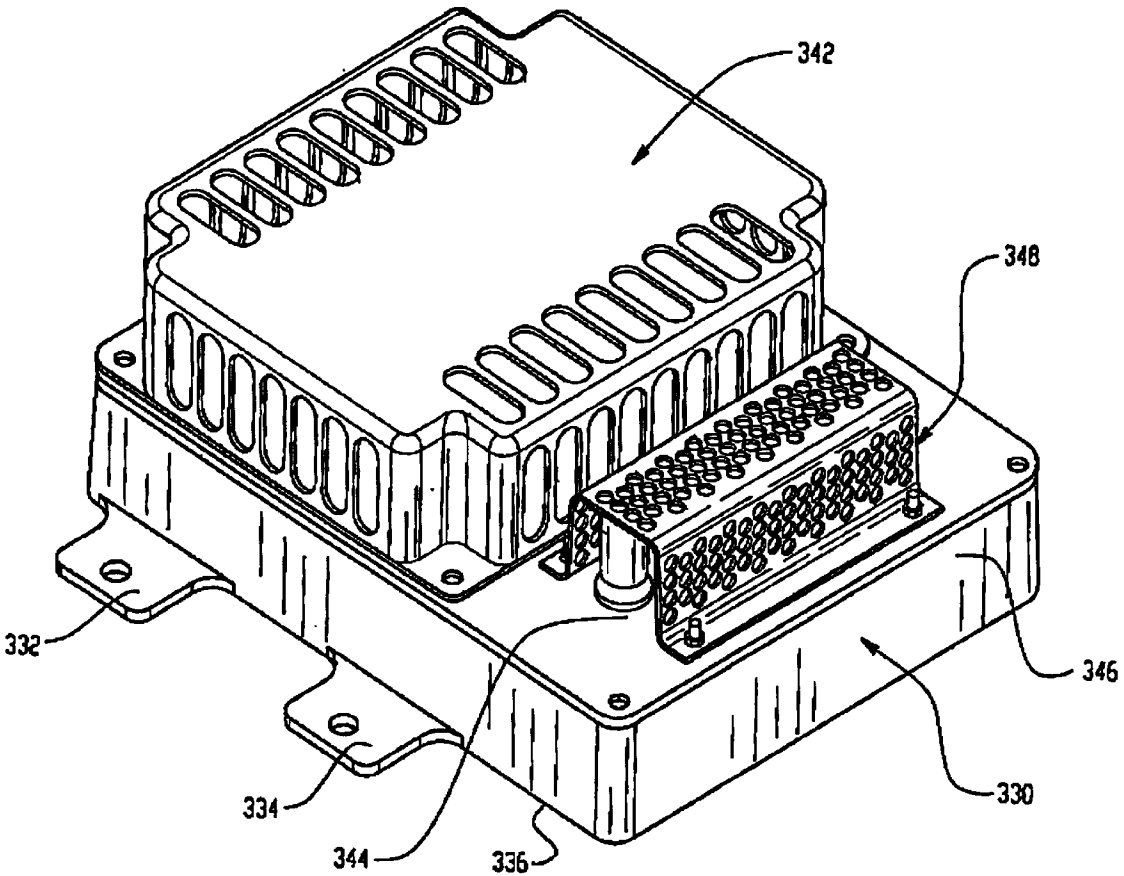
FIG. 17 is an isometric illustration of the self-contained, multi-sensor fire detector assembly of FIG. 16.

An exemplary assembly of the self-contained, multi-sensor fire detector unit 200 is shown in a cross-sectional illustration in FIG. 16 and in an isometric illustration in FIG. 17. Referring to FIGS. 16 and 17, the components of the fire detector unit 200 are assembled in and on a hollow metallic or plastic housing 330 which may have approximate dimensions of six inches by five inches by one and a half inches. One inch wide mounting pads 332 and 334 extend out approximately three quarters of an inch from each side of the bottom 336 of the housing 330. The dual smoke detector unit 202 is mounted on a top surface 338 of the housing 330 in a region 340. A protective, hollow, metal screened housing 342 is mounted to the top surface 338 over the smoke detector unit 202 around the region 340. The housing 340 allows smoke to enter its hollow inner volume while protecting the smoke detector unit 202 from damage.

In addition, the chemical sensors 204, 206, 208 and 210 and temperature sensors 212 and 214 are mounted on another region 344 of the top surface 338. In the present embodiment, the chemical and temperature sensors are aligned substantially along a line close to and parallel with one side 346 of the housing 330. The sensors 204, 208 and 212 are grouped together on one side of the line and the sensors 206, 210 and 214 are grouped together on the other side of the line. The chemical and temperature sensors are covered with a hollow, screened, protective housing 348 which allows the fire byproduct gases to enter the hollow inner volume of the housing 348 while protecting the chemical and temperature sensors from damage. Moreover, connectors 286 and 288 are provided at the side 350, which is opposite side 346, and may protrude out approximately one half an inch from side 350.

The channel A and B control PC cards 250 and 264 which are each approximately three and one-half inches by one and one-half inches in dimension are disposed horizontally side-by-side within the hollow portion of the housing 330. The connectors 286 and 288, smoke detectors and chemical and temperature sensors are coupled to the PC cards 250 and 264 by appropriate wiring as described herein above. All in all, the self contained, fire detector unit 200 is a rugged and robust assembly in a very small and light weight package suitable for use on-board an aircraft where volume and weight is at a premium. In addition, the dual sensor/control architecture of the fire detector 200 renders increased reliability which is particularly desirable for aircraft application.

Figure 18A:
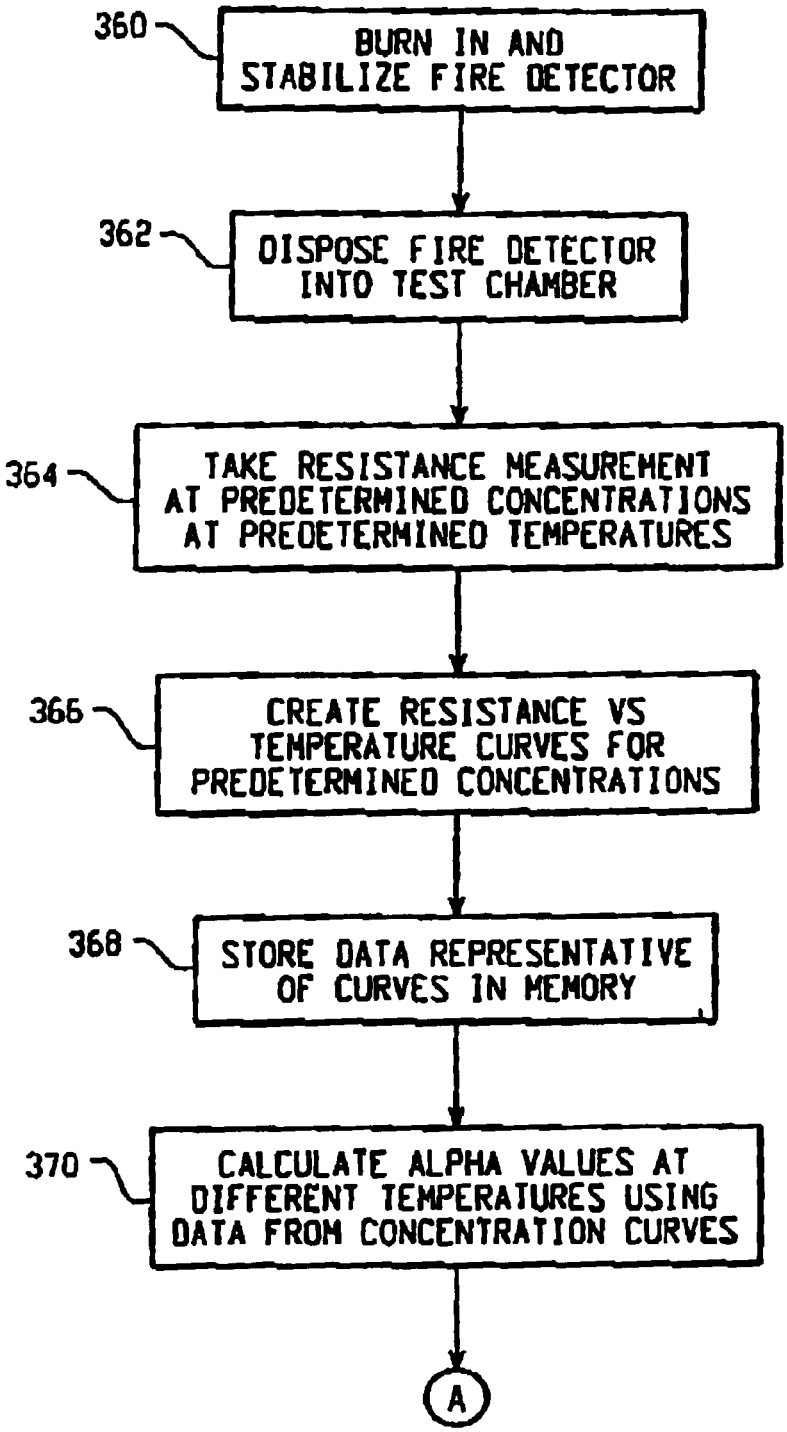
FIGS. 18A and 18B compositely illustrate the steps of an exemplary calibration method for the fire detector unit in accordance with another aspect of the present invention.
Figure 18B:
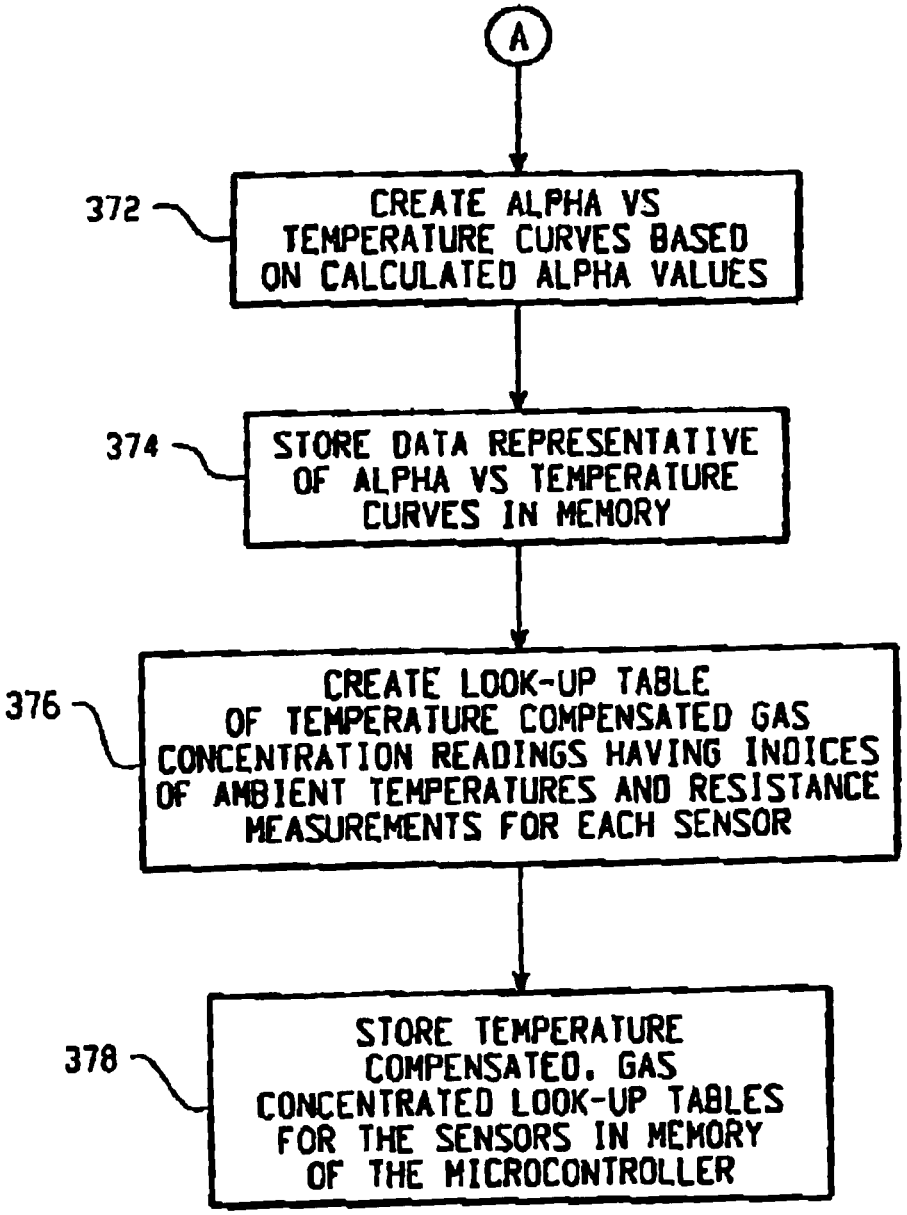

In order to establish high reliability and accuracy for the fire detector unit 200, the chemical sensors thereof are calibrated accurately for gas concentrations and temperature. The procedural flowchart of FIGS. 18A and 18B provide the steps of an exemplary calibration method for the fire detector unit 200. Referring to FIGS. 18A and 18B, in step 360, the assembled fire detector 200 is powered and allowed to run normally at room temperature for a lengthy period of time, like one week, for example, to "burn in" and stabilize the chemical sensors thereof. Thereafter, in step 362, the fire detector 200 is disposed in a test chamber which is operative to heat and cool the ambient temperature of the fire detector 200 to a plurality of predetermined temperature settings over a wide temperature range which may range from −20 to +70° C., for example. Then, in step 364, at each predetermined temperature setting, the fire detector 200 is exposed to a plurality of predetermined gas concentrations of both $H_2$ and CO, like 50 parts per million (ppm), 100 ppm and 300 ppm, for example. At each temperature setting and predetermined $H_2$ gas concentration level, sensor resistance readings are taken for each $H_2$ sensor, and at each temperature setting and predetermined CO gas concentration level, sensor resistance readings are taken for each CO sensor in step 364.

Figure 19:
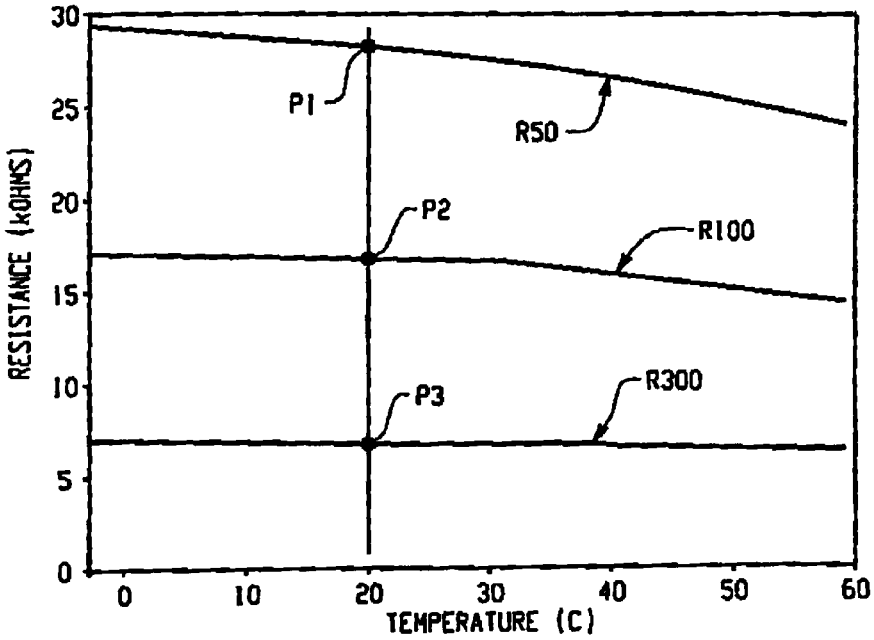
FIG. 19 is a graph of exemplary sensor resistance vs. temperature curves for predetermined gas concentration levels.

Then, in step 366, for each $H_2$ and CO sensor, a resistance vs. temperature curve is created by interpolation for each of the predetermined gas concentrations based on the resistance readings taken in step 364. Exemplary resistance vs. temperature curves of a sensor for the predetermined gas concentration levels of 50, 100 and 300 ppm are shown in the graph of FIG. 19. Data representative of these sensor resistance vs. temperature curves may be stored in a memory, for example, in step 368 for use in calculating temperature compensated, gas concentration readings from the raw sensor measurements as will become better understood from the following description. This curve data may take the form of a look-up table for each predetermined gas concentration curve comprising temperature and corresponding sensor resistance values for a multiplicity of points along the respective curve. Or, each gas concentration curve may be stored in the form of an algebraic expression defining or approximating the respective curve.

A current, temperature compensated, gas concentration reading (ppm) for each chemical sensor is calculated from the current sensor resistance and temperature measurements using an algebraic expression based on an alpha factor as will become better understood from the description herein below. For improved accuracy, two alpha factors, alpha1 and alpha2, may be used for calculating the gas concentration levels. In block 370, for each sensor, alpha1 and alpha2 values are calculated for each of a multiplicity of different temperature readings in accordance with the following expressions:

$$\text{alpha}\mathbf{1}=(\log(R300)-\log(R100))/\log(3);\ \text{and}$$

$$\text{alpha}\mathbf{2}=(\log(R100)-\log(R50))/\log(2),$$

where R50, R100 and R300 are the measured resistances of the corresponding sensor at the gas concentrations of 50, 100 and 300 ppm, respectively, at the corresponding temperature reading. The R50, R100 and R300 values may be obtained from the curve data of step 368. For example, using the curves of FIG. 19 at a temperature of 20° C., the R50, R100 and R300 values would be at points P1, P2 and P3, respectively. If the exact temperature and resistance data is not available from the look-up table, then an interpolation may be employed using higher and lower available temperature and resistance data. All logarithms are to the base 10.

Figure 20:
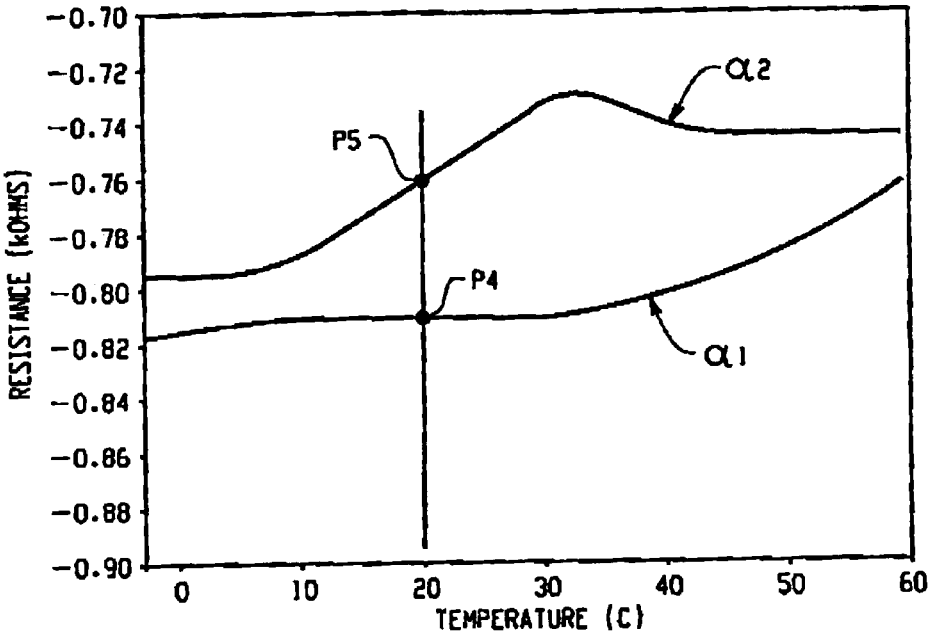
FIG. 20 is a graph of exemplary alpha vs. temperature curves for two different alpha factors.

In step 372, for each sensor, alpha vs. temperature curves are created for each alpha factor based on the calculated alpha values from equations (1) and (2) of step 370. Exemplary alpha1 and alpha2 vs. temperature curves of a sensor are shown in the graph of FIG. 20. Data representative of the alpha vs. temperature curves for each sensor may be stored in memory, for example, in step 374. The data storage of the alpha vs. temperature curves may take the same or similar form to that of the gas concentration resistance vs. temperature curves described above.

Preferably, for each chemical sensor, the resistance values corresponding to the predetermined gas concentration levels, like R50, R100, and R300, for example, and the values of the alpha factors, like alpha1 and alpha 2, for example, for a multiplicity of predetermined temperature readings are calculated and saved for further calculations either through storage in memory in the form of one or more look-up tables or through saving in other media. Using this saved data, for each sensor, a temperature compensated, gas concentration reading may be calculated for each of a plurality of sensor resistance measurements Rx, the corresponding R100 values and appropriate alpha factor values for the each of a plurality of ambient temperatures. A suitable formula for use in calculating the temperature compensated, gas concentration readings C for each sensor is shown by the following expression:

$$C=100\times(Rx/R100)^{(1/alphax)}, \quad (3)$$

where alphax may be either alpha1 or alpha2.

Thus, using the above expression (3) and the predetermined data representative of the alpha factor vs. temperature curves and fixed gas concentration R resistance vs. temperature curves, a look-up table of temperature compensated, gas concentration readings C having indices of ambient temperatures and sensor resistance measurements Rx may be created for each sensor in step 376 and stored in the memory 328 of the microcontroller 304 in step 378 for utilization during a programmed operation thereof as will become more evident from the description found herein below. Alternately, data representative of the alpha factor vs. temperature curves and fixed gas concentration R resistance vs. temperature curves for each sensor may be stored in memory 328 for calculating the temperature compensated, gas concentration readings C during a programmed operation of the microcontroller 304 based on the current sensor resistance measurement Rx and current temperature reading.

Preferably, equation (3) above may be calculated with each of the two alpha factor values, alpha1 and alpha2, for the sensor reading corresponding to 50 ppm taken during calibration. Whichever alpha factor produces the better resultant gas concentration reading C for 50 ppm is used to generate the look-up table for gas concentrations C up to 100 ppm. A similar procedure is repeated with equation (3) for both alpha factor values for the sensor reading corresponding to 300 ppm taken during calibration. Accordingly, whichever alpha factor produces the better resultant gas concentration reading C for 300 ppm is used to generate the remainder of the look-up table for gas concentrations C from 100 ppm to 300 ppm.

Figure 21A:
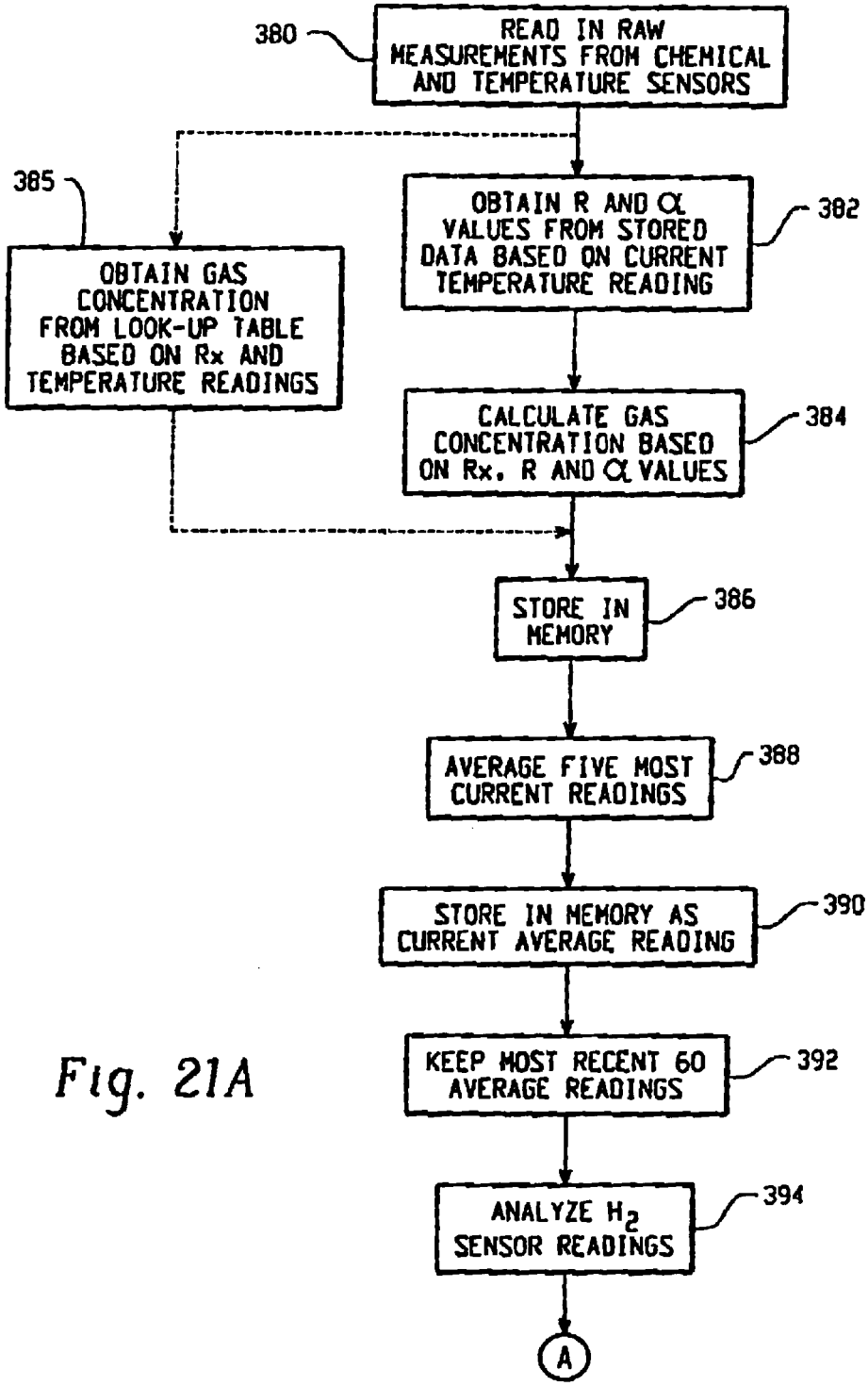
FIGS. 21A–21C compositely illustrate a flowchart of steps of an exemplary operational program suitable for execution in a microcontroller of a channel control unit of FIG. 14.
Figure 21B:
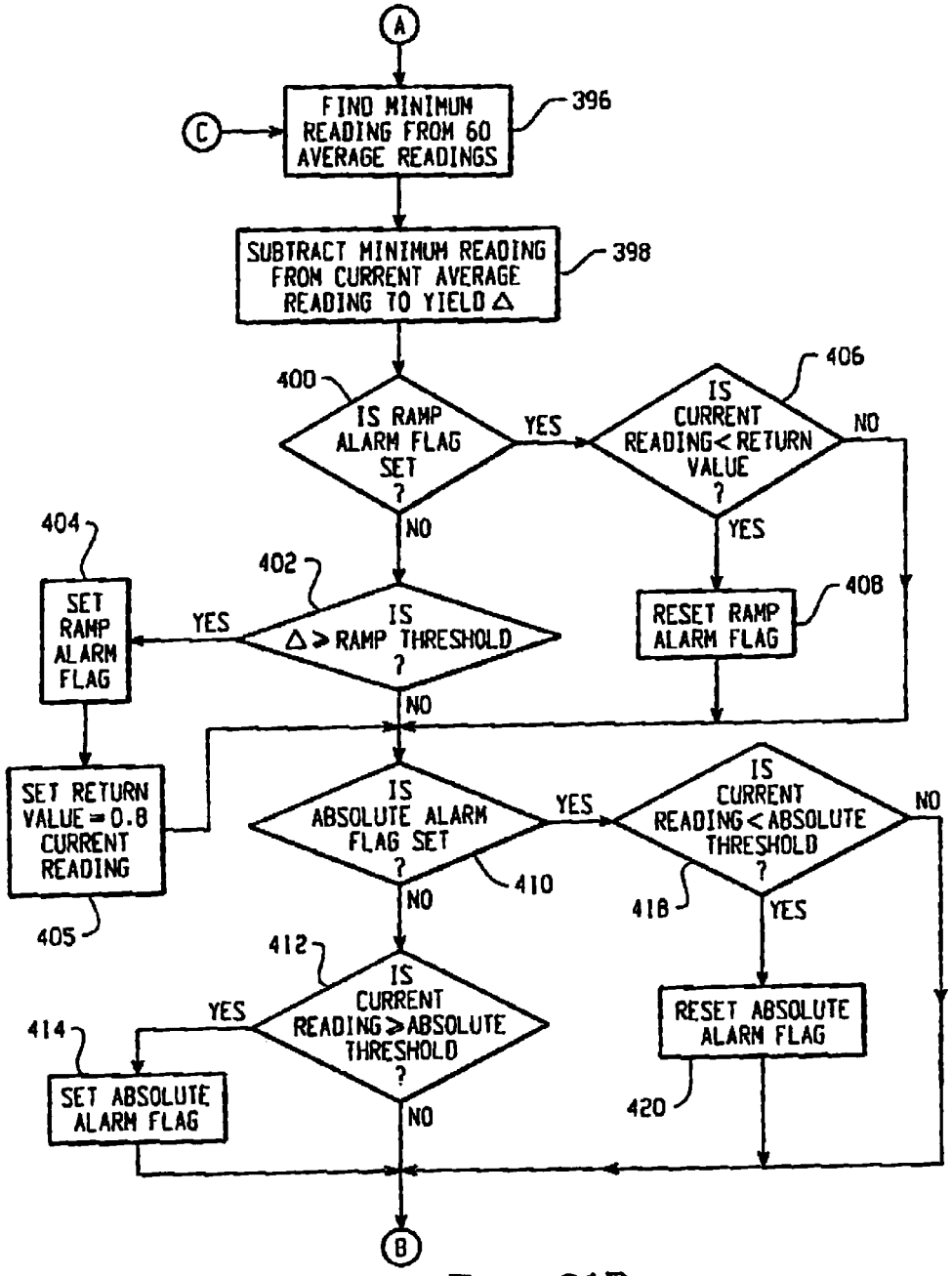
Figure 21C:
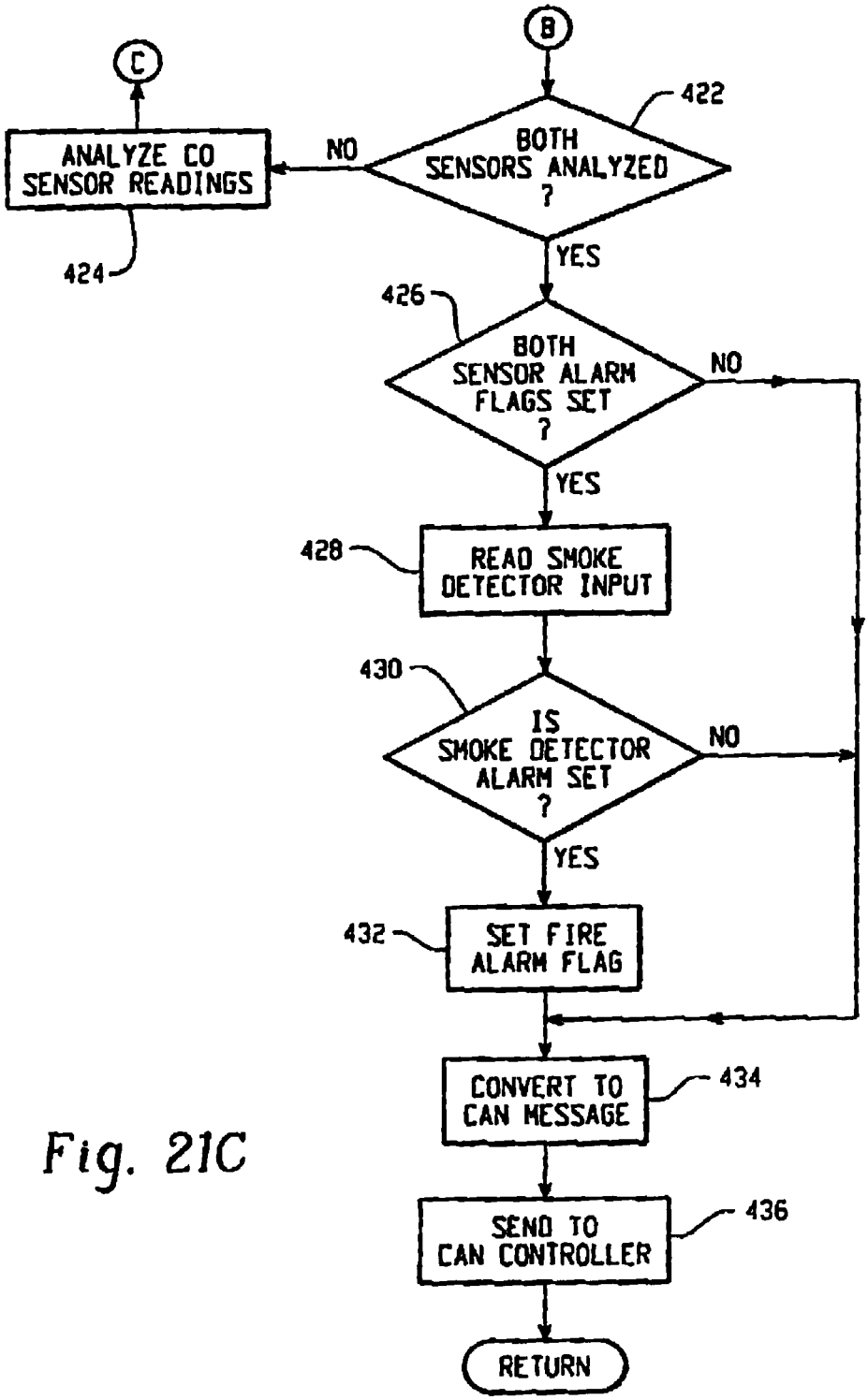

After calibration, the microcontroller 304 of each control PC card 250 and 264 may operate in accordance with the execution of a program to monitor its corresponding smoke detector and chemical and temperature sensors and process the readings thereof to determine reliably and accurately whether or not a fire condition exists and to generate an alarm message accordingly. An exemplary program suitable for execution by the microcontroller 304 to perform the aforementioned functions is shown by the program flowchart of FIGS. 21A, 21B and 21C which may be executed once every second, for example. Referring to FIGS. 21A, 21B, and 21C, in step 380, the raw resistance measurements of the corresponding chemical sensors and the temperature voltage signal are read in and stored. The temperature voltage signal may be converted to a current temperature reading. The following steps will be executed for both the $H_2$ sensor and the CO sensor. However, it is understood that this is purely an arbitrary selection and an alternate program may perform the following steps with one sensor first and then repeat the steps for the other sensor in sequence which will work just as well.

In step 382, for each sensor, the R100 gas concentration and appropriate alpha factor values are accessed from the pre-stored look-up tables based on the current temperature reading. For example, at a current temperature reading of 20° C., point P2 is representative of the accessed R100 value as shown in FIG. 19 and points P4 and P5 are representative of the accessed alpha1 and alpha2 values as shown in FIG. 20. An interpolation may be performed, if the current temperature reading is not one of the temperature points in the look-up tables. Then, in step 384, for each sensor, a temperature compensated, gas concentration reading C is calculated from the actual sensor resistance measurement Rx, and the corresponding R100 and appropriate alpha factor values for the current temperature reading using the formula of equation (3) above.

In the alternative as shown by the dashed lines in FIG. 21A, a temperature compensated, gas concentration reading C for each sensor is obtained in block 385 by accessing the appropriate sensor look-up table pre-stored in memory 328 with the indices of the actual sensor resistance measurement Rx and current temperature reading determined from block 380.

In step 386, the current gas concentration reading C for each sensor is stored in a designated register in memory 328. Thereafter, in step 388, the five most recent gas concentration readings for each sensor are retrieved from memory and averaged to obtain a current average gas concentration reading for each sensor which is stored in a designated register of memory 328 in step 390. Since the sensors are being sampled every one second, the current average gas concentration reading represents an average reading over a five second sliding time window which effects a smoothing of the sensor output. The most recent 60 average gas concentration readings for each sensor are maintained in a block of designated registers of the memory. Accordingly, in step 392, if the current average gas concentration reading is the 61st reading, the 1st reading will be dropped from the block of memory and so on. The operation of step 392 provides for the storage of a sliding window of 60 averaged gas concentration samples in time for each sensor. The reason for this sliding window of average reading samples will become more evident from the following description of the analysis of the gas concentration sensor readings.

Step 394 starts the analysis of the average readings for the $H_2$ sensor. In step 396, a minimum average sensor reading is found from the stored 60 most recent average sensor readings. The minimum average sensor reading is subtracted from the current average sensor reading in step 398 to determine a delta (Δ) which is representative of the rate of change with time or ramp of the respective gas concentration. Next, in step 400, it is determined if the ramp alarm flag is set. If not, in step 402, it is determined if Δ is greater than or equal to a predetermined ramp threshold. (Note that each sensor will have a predetermined ramp threshold.) If so, a ramp alarm flag is set in step 404 and a return value is set to a predetermined percentage, preferably 80%, of the current average sensor reading in step 405. Returning to step 400, if the ramp alarm flag is set, it is next determined in step 406 if the current average sensor reading has fallen below the return value. If so, the ramp alarm flag is reset in step 408. Upon a negative decision from either step 402 or 406 or after execution of either step 405 or 408, program execution continues at step 410.

In step 410, it is determined if the absolute alarm flag is set. If not, it is next determined in step 412 if the current average sensor reading is greater than or equal to a predetermined absolute threshold. (Note that each sensor will have a predetermined absolute threshold.) If so, an absolute alarm flag is set in step 414. Returning to step 410, if the absolute alarm flag is set, it is next determined in step 418 if the current average sensor reading has fallen below the predetermined absolute threshold. If so, the absolute alarm flag is reset in step 420. Upon a negative decision from either step 412 or 418 or after execution of either step 414 or 420, program execution continues at step 422.

In step 422, it is determined if both the $H_2$ and CO sensors have been analyzed. If not, the CO sensor analysis commences in step 424 and the steps 396 through 422 are repeated for the CO sensor readings. Otherwise, program execution continues at step 426 wherein it is determined if an alarm has been set for both of the $H_2$ and CO sensors. Note that in the present embodiment, it does not matter whether the sensor alarm arises from a ramp threshold being exceeded or an absolute threshold being exceeded. If so, then the smoke detector alarm input is read to determine if set by steps 428 and 430. Accordingly, if the smoke detector alarm is set and both of the sensor alarms are set during a current execution of the program, then a fire alarm flag is set in step 432. Otherwise, program execution is returned to an executive program which coordinates and schedules the execution of the programs of the microcontroller whereupon the program may be scheduled for re-execution during the next second interval.

After the fire alarm flag is set in step 432, it is converted to a CAN message in step 434 and the CAN message is sent to the respective CAN controller for transmission over the appropriate CAN bus via the respective CAN transceiver (see FIG. 14). If a fire detector or sensor alarm is reset during a subsequent execution of the program, i.e. all three sensors not indicating an alarm condition, then the fire alarm flag will not be set in step 432 and the steps 434 and 436 will issue a CAN bus message of no fire alarm present. After execution of step 436, program execution is returned to the executive program.

Figure 22:
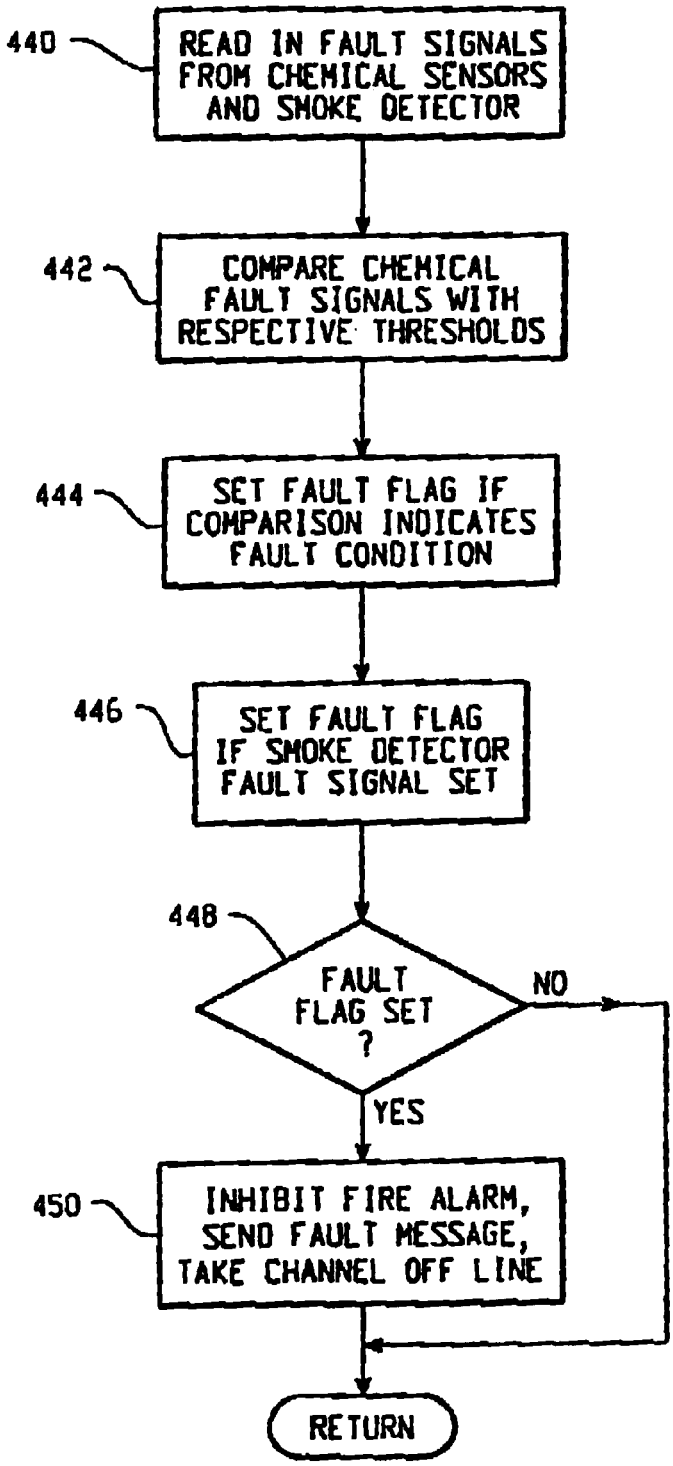
FIG. 22 is a flowchart of steps of another exemplary program suitable for execution in the microcontroller of the channel control unit of FIG. 14.

An exemplary program for execution in the microcontroller 304 for processing the fault signals received from the associated smoke detector via the opto-isolators 320 and chemical sensors via the sensor interface 300 is shown in the program flow chart of FIG. 22. This fault signal processing program may be executed every second by the executive program or executed along with the program described in connection with FIGS. 21A, 21B and 21C, for example. Referring to FIG. 22, the program starts at step 440 wherein the fault signals from the chemical sensors and smoke detector are read in and stored in memory 328 for subsequent analysis. In step 442, the chemical fault signals are compared with respective thresholds or threshold windows and a fault flag is set in step 444 if any comparison indicates a fault condition. Also, the fault flag is set in step 446 if the smoke detector fault signal is set. In the step 448, it is determined if the fault flag is set. If not program execution is returned to the executive program. Otherwise, in step 450, the fire alarm for the respective channel A or B is inhibited, a CAN fault message is sent over the respective CAN bus, and the respective channel is taken off line, i.e. not used for fire alarming within the overall fire detection system. This condition may continue to exist until the fault condition is corrected and the fault flag is determined to be no longer set in step 448. After execution of step 450, the program execution may be returned to the executive program.

While the present invention has been described herein above in connection with a storage compartment of an aircraft, there is no intended limitation thereof to such an application. In fact, the present invention and all aspects thereof could be used in many different applications, storage areas and compartments without deviating from the broad principles thereof. Accordingly, the present invention should not be limited in any way, shape or form to any specific embodiment or application, but rather construed in breadth and broad scope in accordance with the recitation of the claims appended hereto.

We claim:

1. A fire detector unit for detecting fire in a region, said unit comprising:

a chemical sensor for monitoring said region for a combustion chemical and including a first measurable parameter which changes in value proportional to concentration levels of said monitored combustion chemical, said first measurable parameter being ambient temperature dependent;

a temperature sensor disposed in proximity to said chemical sensor and including a second measurable parameter which changes in value proportional to the ambient temperature of said chemical sensor; and a processor circuit coupled to said chemical sensor and temperature sensor for reading said first and second measurable parameters thereof, said processor circuit operative to process said first and second parameter readings to generate a temperature compensated concentration level of said monitored combustion chemical based on a function of said first and second parameter readings and a selected one of first and second temperature factor values, each said first and second temperature factor value being based on first parameter measurements corresponding to a plurality of predetermined combustion chemical concentration levels, and to generate an alarm based on said generated temperature compensated concentration level.

2. The fire detector unit of claim 1 including a memory storing a look-up table of temperature compensated, gas concentration levels of the monitored combustion chemical for each of the first and second temperature factor values; and wherein the processor is coupled to said memory and operative to select a look-up table and utilize said selected look-up table based on the first and second parameter readings to generate the temperature compensated concentration level of the monitored combustion chemical.

3. The fire detector unit of claim 2 wherein the temperature compensated, gas concentration levels of each look-up table are based on a function of the first parameter reading, and the corresponding temperature factor value, said corresponding temperature factor value determined from first parameter measurements corresponding to first and second predetermined combustion chemical concentrations associated with the second parameter reading.

4. The fire detector unit of claim 1 including a memory for storing data representative of a first temperature factor value vs. temperature curve and data representative of a second temperature factor value vs. temperature curve; and wherein the processor circuit is operative to access a selected one of the first and second temperature factor values from said stored data based on the second parameter reading for use in generating the temperature compensated concentration level.

5. The fire detector unit of claim 1 wherein the processor circuit is operative to generate an alarm based on a comparison of the generated temperature compensated concentration level and an absolute threshold.

6. The fire detector unit of claim 1 wherein the processor circuit is operative to generate an alarm based on a comparison of a time rate of the generated temperature compensated concentration level and a ramp threshold.

7. The fire detector unit of claim 1 wherein the processor circuit is operative to read time samples of the first measurable parameter and to generate a temperature compensated concentration level for each time sample based on said time sample readings; and including a memory, said processor operative to store in said memory a sliding window in time of a predetermined number of most recent generated temperature compensated concentration levels.

8. The fire detector unit of claim 7 wherein the processor circuit is operative to derive a time rate of the generated temperature compensated concentration levels as a difference of a current generated temperature compensated concentration level and a minimum generated temperature compensated concentration level from the stored predetermined number of generated temperature compensated concentration levels, and to set an alarm based on a comparison of the time rate of the generated temperature compensated concentration levels and a ramp threshold.

9. The fire detector unit of claim 8 wherein the processor circuit is operative to reset the alarm when the current generated temperature compensated concentration level of a time sample subsequent to setting the alarm falls below a return value.

10. The fire detector unit of claim 9 wherein the return value is a predetermined percentage of the current generated temperature compensated concentration level used to derive the time rate used to set the alarm.

11. The fire detector unit of claim 1 wherein the combustion chemical sensor comprises a sensor selected from the group consisting of a hydrogen gas sensor and a carbon monoxide gas sensor.

12. A method of detecting a combustion chemical in a region and setting an alarm based on concentration levels of the combustion chemical, said method comprising the steps of:

monitoring said region for a combustion chemical with a sensor having a measurable parameter which changes in value proportional to concentration levels of said monitored combustion chemical, said measurable parameter being ambient temperature dependent;

generating an ambient temperature measurement of said sensor; and reading said measurable parameter and ambient temperature measurement;

processing said measurable parameter and ambient temperature measurement readings to generate a temperature compensated concentration level of said monitored combustion chemical based on a function of said measurable parameter and ambient temperature measurement readings and a selected one of first and second temperature factor values, each said first and second temperature factor value being based on measurable parameter readings corresponding to a plurality of predetermined combustion chemical concentration levels; and setting an alarm based on said generated temperature compensated concentration level.

13. The method of claim 12 including the steps of: storing a look-up table of temperature compensated, gas concentration levels of the monitored combustion chemical for each of the first and second temperature factor values; selecting a look-up table; and utilizing said selected look-up table based on the measurable parameter and ambient temperature measurement readings to generate the temperature compensated concentration level of the monitored combustion chemical.

14. The method of claim 13 including the step of generating the temperature compensated, gas concentration levels of each look-up table based on a function of the measurable parameter reading, and the corresponding temperature factor value, said corresponding temperature factor value determined from measurable parameter readings corresponding to first and second predetermined combustion chemical concentrations associated with the ambient temperature measurement reading.

15. The method of claim 12 including the steps of storing data representative of a first temperature factor value vs. temperature curve and data representative of a second temperature factor value vs. temperature curve; and accessing a selected one of the first and second temperature factor values from said stored data based on the ambient temperature measurement reading.

16. The method of claim 12 wherein the alarm is set based on a comparison of the generated temperature compensated concentration level and an absolute threshold.

17. The method of claim 12 wherein the alarm is set based on a comparison of a time rate of change of the generated temperature compensated concentration level and a ramp threshold.

18. The method of claim 12 wherein the step of reading includes reading time samples of the measurable parameter; and wherein a temperature compensated concentration level is generated for each time sample based on said time sample readings; and including the step of storing a sliding window in time of a predetermined number of most recent generated temperature compensated concentration levels.

19. The method of claim 18 including the steps of deriving a time rate of the generated temperature compensated concentration levels as a difference of a current generated temperature compensated concentration level and a minimum generated temperature compensated concentration level from the stored predetermined number of generated temperature compensated concentration levels; and setting the alarm based on a comparison of the time rate of the generated temperature compensated concentration levels and a ramp threshold.

20. The method of claim 19 including the step of resetting the alarm when the current generated temperature compensated concentration level of a time sample subsequent to setting the alarm falls below a return value.

21. The method of claim 20 including the step of determining the return value as a predetermined percentage of the current generated temperature compensated concentration level used to derive the time rate used to set the alarm.

22. A method of calibrating a fire detector unit comprising a sensor for monitoring a region for a combustion chemical, said method comprising the steps of:

measuring a parameter of said sensor at a plurality of predetermined chemical concentration levels and at a plurality of predetermined first temperatures, said sensor parameter changing in value proportional to concentration levels of said monitored combustion chemical and ambient temperature;

creating measured parameter vs. temperature curve data for each of said plurality of predetermined chemical concentration levels based on said parameter measurements;

deriving first and second temperature factors at a plurality of second temperatures based on said created measured parameter vs. temperature curve data;

creating a first look-up table of temperature compensated, gas concentration levels of the monitored combustion chemical from the measured parameter vs. temperature curve data and the derived first temperature factors; and creating a second look-up table of temperature compensated, gas concentration levels of the monitored combustion chemical from the measured parameter vs. temperature curve data and the derived second temperature factors.

23. The calibration method of claim 22 including the step of burning in the sensor under operating conditions for a predetermined time period.

24. The calibration method of claim 22 including disposing the fire detector unit in a test chamber for performing the step of measuring the sensor parameter.

25. The calibration method of claim 22 wherein the sensor parameter being measured comprises resistance.

26. The calibration method of claim 22 wherein the first temperature factors are derived at the plurality of second temperatures based on a function of sensor parameter measurements at first and second predetermined chemical concentration levels and corresponding second temperatures.

27. The calibration method of claim 26 wherein the second temperature factors are derived at the plurality of second temperatures based on a function of sensor parameter measurements at second and third predetermined chemical concentration levels and corresponding second temperatures.

28. The calibration method of claim 22 including the step of storing the first and second look-up tables of temperature compensated, gas concentration levels in the fire detector unit.

29. A self-contained, fire detector unit for detecting fire in a region, said unit comprising:

a smoke detector for monitoring said region for smoke and generating a smoke alarm signal upon the detection of smoke in said region;

a plurality of chemical sensors, each sensor of said plurality for monitoring said region for a different combustion chemical and including a first measurable parameter which changes in value proportional to concentration levels of said monitored combustion chemical, said first measurable parameter being ambient temperature dependent;

a temperature sensor disposed in proximity to said plurality of chemical sensors and including a second measurable parameter which changes in value proportional to the ambient temperature of said chemical sensors; and a processor circuit coupled to said plurality of chemical sensors, smoke detector and temperature sensor for reading the smoke alarm signal and said first and second measurable parameters thereof, said processor circuit operative to process said first parameter readings of each chemical sensor and said second parameter readings to generate a corresponding temperature compensated concentration level of said monitored combustion chemical of each chemical sensor, each generation of the temperature compensated concentration level being based on a function of the first parameter readings of the corresponding chemical sensor and the second parameter readings and a selected one of first and second temperature factor values, each said first and second temperature factor value being based on the corresponding chemical sensor's first parameter measurements corresponding to a plurality of predetermined combustion chemical concentration levels, and to generate an alarm based on a combination of said smoke alarm reading and generated temperature compensated concentration levels of the chemical sensors of said plurality.

30. The fire detector unit of claim 29 including:

a hollow housing having a top surface;

wherein the smoke detector is disposed at a first area of said top surface;

wherein the plurality of chemical sensors and the temperature sensor are disposed at a second area of said top surface; and wherein the processor circuit is disposed within the hollow housing.

31. The fire detector unit of claim 30 including:

a first screened, protective shield disposed over the smoke detector and mounted to the top surface; and a second screened, protective shield disposed over the plurality of combustion chemical sensors and the temperature sensor and mounted to the top surface.

32. The fire detector unit of claim 29 wherein the smoke detector includes built-in test circuitry for generating a first fault signal indicative of a fault condition in the smoke detector; and wherein the processor circuit includes: test circuitry coupled to each of the plurality of combustion chemical sensors for detecting a fault condition therein and for generating a second fault signal indicative of said fault condition; and means for inhibiting the generation of the fire alarm based on said first and second fault signals.

33. The fire detector unit of claim 32 including;

a communication bus;

a communication controller and transmitter coupled between the processor circuit and communication bus; and wherein the processor circuit includes means for converting the fire alarm and fault signals into corresponding alarm and fault messages; and means for controlling said communication controller and transmitter for transmitting said alarm and fault messages over said communication bus.

34. The fire detector unit of claim 29 wherein the processor circuit comprises a programmed microcontroller.

35. The fire detector unit of claim 29 wherein the processor circuit includes: means for generating a sensor alarm signal for each chemical sensor of said plurality based on the generated temperature compensated concentration level corresponding to said chemical sensor; and means for generating the alarm based on a condition in which the smoke alarm signal and sensor alarm signals for all of the chemical sensors of said plurality are concurrently generated.

36. The fire detector unit of claim 29 wherein the plurality of combustion chemical sensors comprises: a hydrogen gas sensor and a carbon monoxide gas sensor.

37. A self-contained, dual channel fire detector unit for detecting fire in a region, said unit comprising:

a first channel comprising:

a first smoke detector for monitoring said region for smoke and generating a first smoke alarm signal upon the detection of smoke in said region;

a first plurality of combustion chemical sensors, each sensor of said first plurality for monitoring said region for a different combustion chemical and including a first measurable parameter which changes in value proportional to concentration levels of said monitored combustion chemical, said first measurable parameter being ambient temperature dependent;

a first temperature sensor disposed in proximity to said first plurality of combustion chemical sensors and including a second measurable parameter which changes in value proportional to the ambient temperature of said combustion chemical sensors; and a first processor circuit coupled to said first plurality of combustion chemical sensors, first smoke detector and first temperature sensor for reading the first smoke alarm signal and said first and second measurable parameters thereof, said first processor circuit operative to process said first parameter readings of each chemical sensor of said first plurality to generate a corresponding temperature compensated concentration level of said monitored combustion chemical based on the second parameter readings, and to generate a first alarm based on a combination of said first smoke alarm reading and generated temperature compensated concentration levels of the chemical sensors of said first plurality; and a second channel comprising:

a second smoke detector for monitoring said region for smoke and generating a second smoke alarm signal upon the detection of smoke in said region;

a second plurality of combustion chemical sensors, each sensor of said second plurality for monitoring said region for a different combustion chemical and including a first measurable parameter which changes in value proportional to concentration levels of said monitored combustion chemical, said first measurable parameter being ambient temperature dependent;

a second temperature sensor disposed in proximity to said second plurality of combustion chemical sensors and including a second measurable parameter which changes in value proportional to the ambient temperature of said combustion chemical sensors; and a second processor circuit coupled to said second plurality of combustion chemical sensors, second smoke detector and second temperature sensor for reading the second smoke alarm signal and said first and second measurable parameters thereof, said second processor circuit operative to process said first parameter readings of each chemical sensor of said second plurality to generate a corresponding temperature compensated concentration level of said monitored combustion chemical based on the second parameter readings, and to generate a second alarm based on a combination of said second smoke alarm reading and generated temperature compensated concentration levels of the chemical sensors of said second plurality.

38. The fire detector unit of claim 37 wherein the first and second channels are separate and independent of each other.

39. The fire detector unit of claim 37 including:

a hollow housing having a top surface;

wherein the first and second smoke detector are disposed at a first area of said top surface;

wherein the first plurality of combustion chemical sensors and the first temperature sensor are disposed at a second area of said top surface;

wherein the second plurality of combustion chemical sensors and the second temperature sensor are disposed at a third area of said top surface; and wherein the first and second processor circuits are disposed within the hollow housing.

40. The fire detector unit of claim 39 wherein the first and second smoke detectors are contained in a common package.

41. The fire detector unit of claim 39 including:

a first screened, protective shield disposed over the first and second smoke detectors and mounted to the top surface; and a second screened, protective shield disposed over the first and second plurality of combustion chemical sensors and the first and second temperature sensors and mounted to the top surface.

42. The fire detector unit of claim 37 wherein the each of the first and second smoke detectors includes built-in test circuitry for generating first and second fault signals indicative of a fault condition in the first and second smoke detectors, respectively; wherein the first processor circuit includes: test circuitry coupled to each of the first plurality of combustion chemical sensors for detecting a fault condition therein and for generating a third fault signal indicative of said fault condition; and means for inhibiting the generation of the first fire alarm based on said first and third fault signals; and wherein the second processor circuit includes: test circuitry coupled to each of the second plurality of combustion chemical sensors for detecting a fault condition therein and for generating a fourth fault signal indicative of said fault condition; and means for inhibiting the generation of the second fire alarm based on said second and fourth fault signals.

43. The fire detector unit of claim 42 wherein the first processor circuit includes means for controlling the disposition of the first channel based on the first and third fault signals; and wherein the second processor circuit includes means for controlling the disposition of the second channel based on the second and fourth fault signals.

44. The fire detector unit of claim 42 wherein the first channel includes; a first communication bus; and a first bus controller and transmitter coupled between the first processor circuit and first communication bus; and wherein the first processor circuit includes means for converting the first fire alarm and first and third fault signals into corresponding alarm and fault messages; and means for controlling said first bus controller and transmitter for transmitting said alarm and fault messages over said first communication bus; and wherein the second channel includes; a second communication bus; and a second bus controller and transmitter coupled between the second processor circuit and second communication bus; and wherein the second processor circuit includes means for converting the second fire alarm and second and fourth fault signals into corresponding alarm and fault messages; and means for controlling said second bus controller and transmitter for transmitting said alarm and fault messages over said second communication bus.

45. The fire detector unit of claim 37 wherein the each of the first and second plurality of combustion chemical sensors comprises: a hydrogen gas sensor and a carbon monoxide gas sensor.

46. A fire detector unit for detecting fire in a region, said unit comprising:

a chemical sensor for monitoring said region for a combustion chemical and including a first measurable parameter which changes in value proportional to concentration levels of said monitored combustion chemical, said first measurable parameter being ambient temperature dependent;

a temperature sensor disposed in proximity to said chemical sensor and including a second measurable parameter which changes in value proportional to the ambient temperature of said chemical sensor; and a processor circuit coupled to said chemical sensor and temperature sensor for reading time samples of said first and second measurable parameters thereof, said processor circuit operative to process said time samples of said first and second parameter readings to generate a temperature compensated concentration level of said monitored combustion chemical for each time sample, and to generate an alarm based on said temperature compensated concentration levels of said time samples, said processor circuit also operative to reset said alarm when the generated temperature compensated concentration level of a time sample subsequent the setting of said alarm falls below a return value.

47. The fire detector unit of claim 46 wherein the return value is a predetermined percentage of the generated temperature compensated concentration level used to set the alarm.

48. A method of detecting a combustion chemical in a region and setting an alarm based on concentration levels of the combustion chemical, said method comprising the steps of:

monitoring said region for a combustion chemical with a sensor having a measurable parameter which changes in value proportional to concentration levels of said monitored combustion chemical, said measurable parameter being ambient temperature dependent;

generating an ambient temperature measurement of said sensor; and reading time samples of said measurable parameter and ambient temperature measurement;

processing said time samples of said measurable parameter and ambient temperature measurement readings to generate a temperature compensated concentration level of said monitored combustion chemical for each time sample;

setting an alarm based on said generated temperature compensated concentration level; and resetting said alarm when the generated temperature compensated concentration level of a time sample subsequent the setting of the alarm falls below a return value.

49. The method of claim 48 including the step of determining the return value as a percentage of the generated temperature compensated concentration level used to set the alarm.

* * * * *